US009307825B2

(12) United States Patent
Dondi et al.

(10) Patent No.: US 9,307,825 B2
(45) Date of Patent: Apr. 12, 2016

(54) TOOL FOR CLEANING SURFACES

(75) Inventors: Andrea Dondi, Casinalbo (IT); Roberto Dondi, Casinalbo (IT)

(73) Assignee: NUOVA F.LLI DONDI S.R.L. (IT)

( * ) Notice: Subject to any disclaimer, the term of this patent is extended or adjusted under 35 U.S.C. 154(b) by 773 days.

(21) Appl. No.: 12/666,092

(22) PCT Filed: Jun. 18, 2008

(86) PCT No.: PCT/IB2008/001582

§ 371 (c)(1),
(2), (4) Date: Apr. 23, 2010

(87) PCT Pub. No.: WO2009/001186

PCT Pub. Date: Dec. 31, 2008

(65) Prior Publication Data

US 2010/0205759 A1 Aug. 19, 2010

(30) Foreign Application Priority Data

Jun. 22, 2007 (IT) ..... MO07A0215

(51) Int. Cl.
*A46B 5/00* (2006.01)
*A46B 7/04* (2006.01)

(52) U.S. Cl.
CPC ..... *A46B 5/0058* (2013.01); *A46B 5/0083* (2013.01); *A46B 7/04* (2013.01); *A46B 2200/302* (2013.01)

(58) Field of Classification Search
CPC ..... A47L 13/257; A47L 13/46; A47L 13/12; E21B 17/046; F16B 21/18; F16B 21/186; A46B 5/0083; A46B 7/044
USPC ..... 15/144.1, 144.2, 145, 172, 244.2; 403/321, 326–328; 81/177.6, 177.8, 81/177.9; 16/436, DIG. 41
See application file for complete search history.

(56) References Cited

U.S. PATENT DOCUMENTS

| | | | | |
|---|---|---|---|---|
| 881,782 | A * | 3/1908 | Elliot | 294/51 |
| 974,331 | A * | 11/1910 | Aasen | 81/132 |
| 1,755,486 | A * | 4/1930 | Odell | 81/177.9 |
| 2,304,745 | A * | 12/1942 | Wied | 403/33 |
| 4,819,294 | A * | 4/1989 | Calvert | 15/209.1 |
| 5,390,390 | A | 2/1995 | Kresse | |
| 5,414,889 | A * | 5/1995 | Sartori | 15/159.1 |
| 5,615,442 | A | 4/1997 | Schroeck | |
| 6,315,341 | B1 * | 11/2001 | Leon et al. | 294/53.5 |
| 6,625,837 | B2 * | 9/2003 | Jiang | 15/105 |
| 7,032,941 | B2 * | 4/2006 | Heneveld | 294/51 |
| 7,509,893 | B2 * | 3/2009 | Wu | 81/177.8 |
| 7,735,182 | B2 * | 6/2010 | Morris et al. | 15/228 |

(Continued)

FOREIGN PATENT DOCUMENTS

| | | |
|---|---|---|
| CA | 2226465 A1 | 7/1999 |
| EP | 0350456 A2 | 1/1990 |

(Continued)

*Primary Examiner* — Rachel Steitz
*Assistant Examiner* — Jennifer Gill
(74) *Attorney, Agent, or Firm* — Laubscher, Spendlove & Laubscher, P.C.

(57) ABSTRACT

A tool for cleaning surfaces includes a supporting element that holds a plurality of bristles, or groups of bristles, and a handle for gripping and maneuvering the tool, the tool further including a coupling element that can be removably connected to the supporting element and to which the handle can be removably connected.

22 Claims, 19 Drawing Sheets

(56) References Cited

U.S. PATENT DOCUMENTS

| | | | | |
|---|---|---|---|---|
| 7,854,037 | B2 * | 12/2010 | Lu | 15/210.1 |
| 2003/0180085 | A1 | 9/2003 | Hughes | |
| 2005/0102781 | A1 * | 5/2005 | Tsuchiya et al. | 15/147.2 |
| 2005/0265769 | A1 * | 12/2005 | Blom | 401/139 |
| 2006/0000041 | A1 * | 1/2006 | Streutker et al. | 15/144.1 |
| 2006/0037159 | A1 * | 2/2006 | Wang | 15/144.1 |
| 2006/0117511 | A1 | 6/2006 | Weaver | |
| 2006/0171764 | A1 * | 8/2006 | Hoadley | 401/123 |
| 2006/0191088 | A1 * | 8/2006 | Goulet et al. | 15/144.1 |
| 2007/0283790 | A1 * | 12/2007 | Cheng | 81/177.9 |

FOREIGN PATENT DOCUMENTS

| | | | |
|---|---|---|---|
| EP | 1782712 | A1 | 5/2007 |
| JP | 2005103246 | A | 4/2005 |
| RU | 2159070 | C2 | 11/2000 |
| WO | 2005044042 | A2 | 5/2005 |

* cited by examiner 16
20
20
19
9
8

16
10
20
21
20
21
23
17
9
23
8

17
10
21
20
23
9
11
8

TOOL FOR CLEANING SURFACES

This application is a continuation of PCT International Application No. PCT/IB2008/001582 filed Jun. 18, 2008. PCT/IB2008/001582 claims priority to IT Application No. MO2007A000215 filed Jun. 22, 2007. The entire contents of this application are incorporated herein by reference.

The present invention relates to a tool for cleaning surfaces, in particular indoor and outdoor floors. As is known, tools for cleaning surfaces, in particular floors, such as, for example, brooms, may consist of a plate that supports a plurality of bristles and of a handle fixed at an end to the aforesaid plate. The bristles may consist of threads made of plastics, or other material, for example at a maximum tilt of 30° in relation to the supporting plate and with a maximum axial length of 15 centimeters. This tilt is made along the longitudinal axis of the supporting plate.

The main drawback, which is encountered above all in brooms for cleaning large surfaces, consists of the great stress to which the user is subject when he uses the broom. In fact, in use, the user grips the handle with both hands and to these all the mechanical stress is transmitted that arises from the friction between the bristles and the floor affected by cleaning.

A further drawback that is found in the aforesaid brooms derives from the system for fixing the handle to the aforesaid plate. In many cases, the end portion of the handle intended to be fixed to the plate is deformed so as to take on a substantially flat configuration. It appears obvious that such a deformation operation is not only expensive but causes less mechanical resistance of the handle with a consequent great risk of breakage of the handle at the deformed end.

From the state of the art brooms are known that include a supporting element for the bristles and a handle connected to the supporting element by a damping arrangement suitable for damping mechanical stress transmitted along said handle.

Brooms are further known that include: a supporting element for the bristles, a coupling element that extends from a surface of the supporting element, and a handle connected to the coupling element, with an axial end portion of the handle that is associated with a connecting arrangement suitable for connecting the axial end portion of the handle to the coupling element.

The position of the handle in relation to the supporting plate of the bristles is substantially fixed, which makes the use of the tool inconvenient, in particular when portions of surfaces have to be cleaned that, in order to be reached easily, would require the tilt of the handle to be modified in relation to the supporting plate of the bristles.

Tools are also known for cleaning surfaces in which it is possible to vary the tilt of the handle in relation to the supporting plate of the bristles, but this operation is generally complex and not easy to perform, in addition there is no absolute guarantee of the tilted position of the handle being maintained in relation to the supporting plate of the bristles.

Lastly, replacing the supporting plate of the bristles is complex and requires a considerable outlay of time.

The present invention intends to remedy the aforesaid drawbacks.

According to the present invention a tool is provided for cleaning surfaces including a supporting element that holds a plurality of bristles, or groups of bristles and a handle for gripping and maneuvering the tool, wherein it further includes a coupling element that can be removably connected to the supporting element and to which the handle can be removably connected.

The tool according to the invention enables the supporting element of the bristles to be replaced simply and rapidly when the latter are worn.

According to an embodiment of the present invention, between the coupling element and the handle there is provided an attachment element, to which the handle is affixed in a movable manner, the attachment element having an angular position that is adjustable in relation to the coupling element.

This enables the tilt of the handle of the tool to be adjusted so as to optimise the manageability of the tool according to the invention substantially in any condition of use.

According to a further embodiment of the present invention, a damping arrangement is provided between the handle and the attachment element, to dampen and/or absorb possible anomalous stress, arising, for example, from impact of the supporting element of the bristles against obstacles while the tool is used.

Certain methods of implementing the invention will be disclosed below by way of non-limiting example with reference to the attached drawings, in which.

Figures 8, 9, 10:
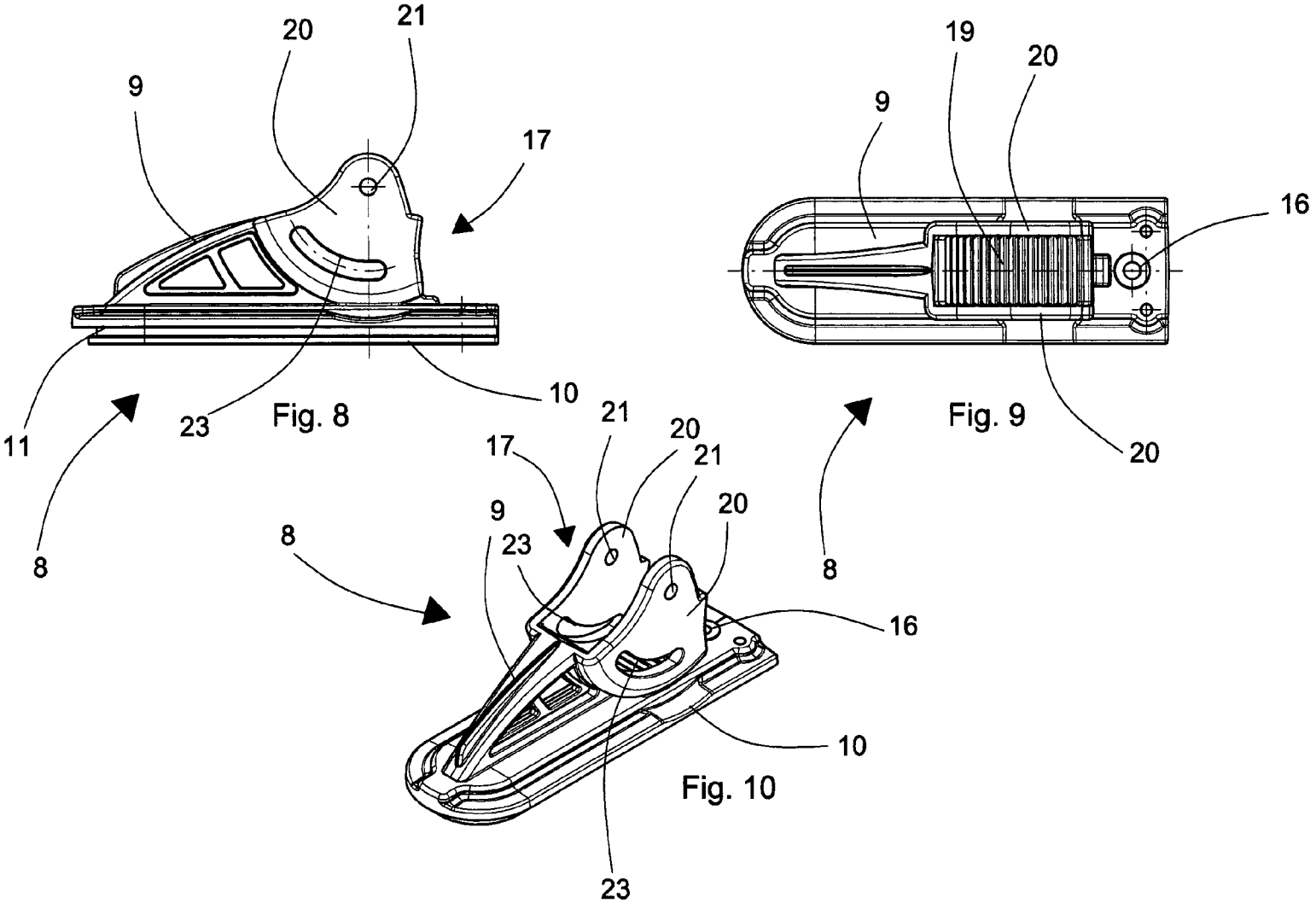
FIG. 8 is a raised view of a second embodiment of a coupling element for coupling a handle with the supporting element of the bristles.
FIG. 9 is a top view of the coupling element in FIG. 8.
FIG. 10 is a perspective view of the coupling element in FIG. 8.
Figure 14:
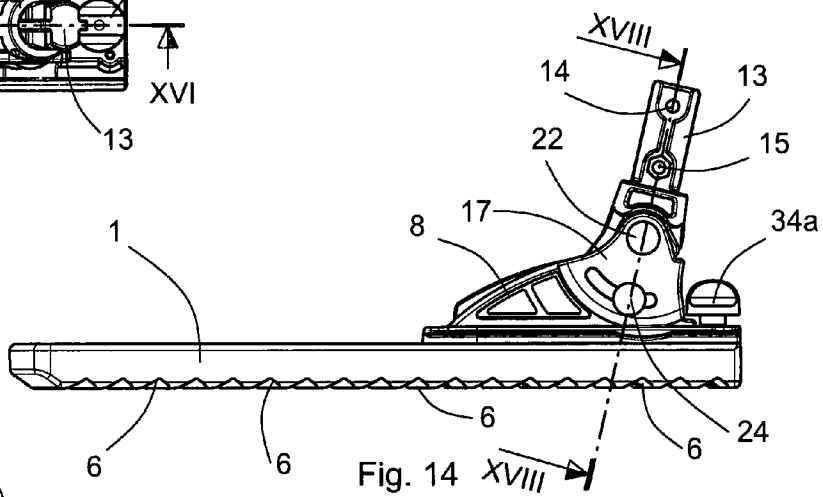
FIG. 14 is a raised view of a set consisting of the coupling element in FIG. 8, inserted into the supporting element of the bristles in FIG. 1, and of the attachment element in FIGS. 11 to 13.
Figure 16B:
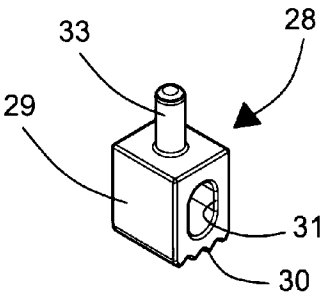
FIG. 16 is section XVI-XVI of FIG. 15.
Figure 16A:
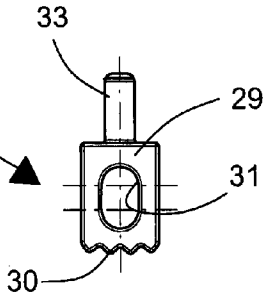
Figure 16:
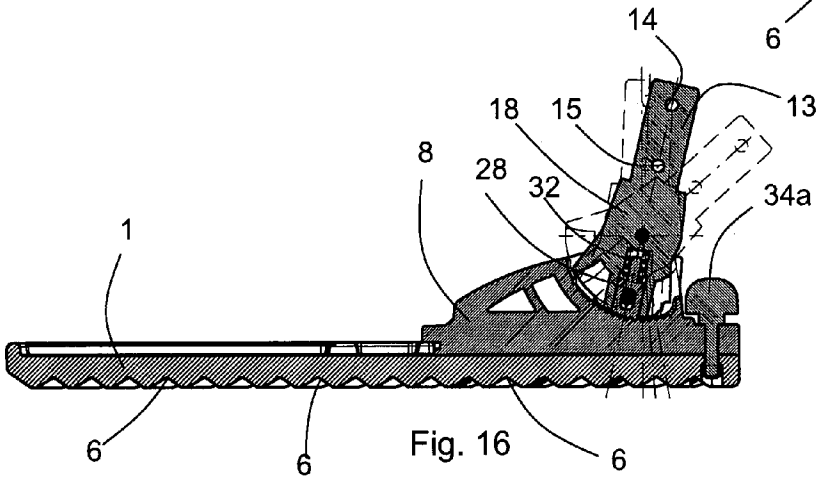
Figure 18:
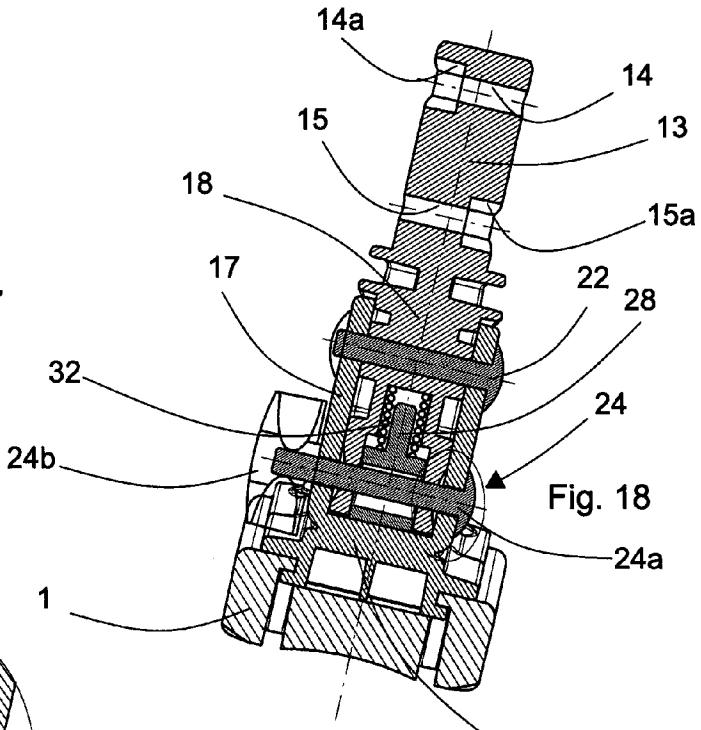
Figure 17:
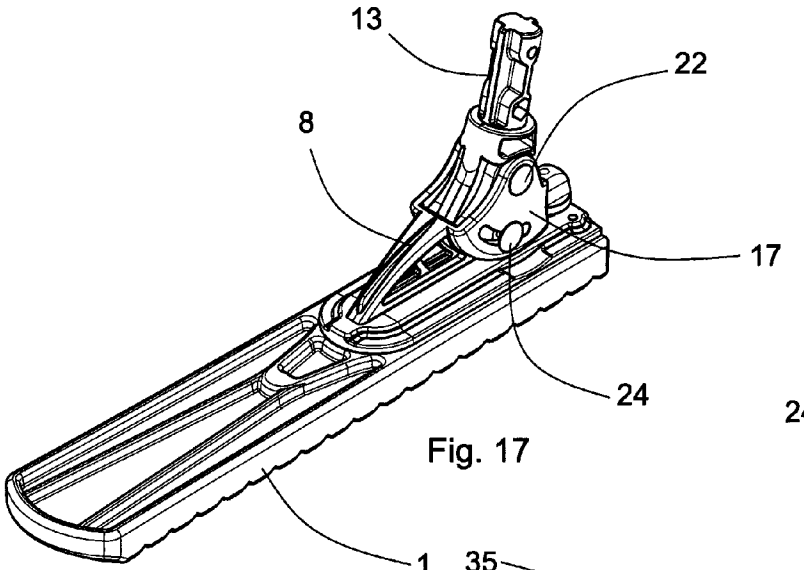
Figure 19:
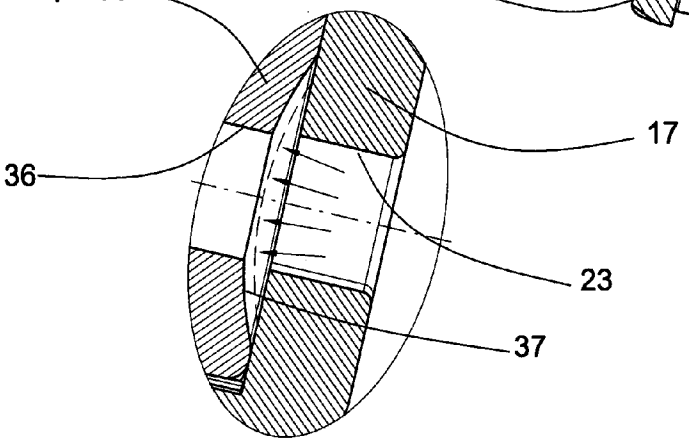
Figures 20, 21, 22:
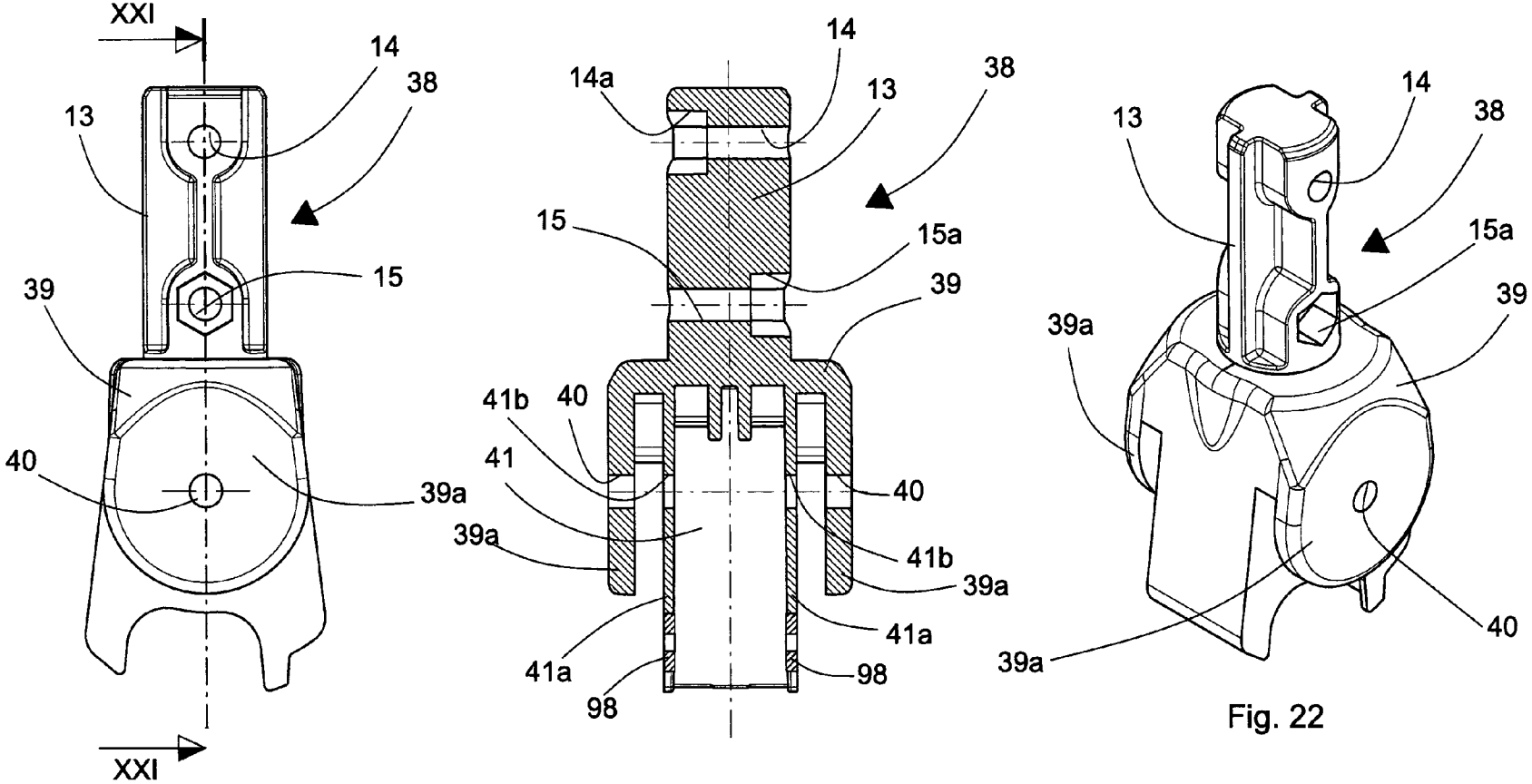
Figure 25:
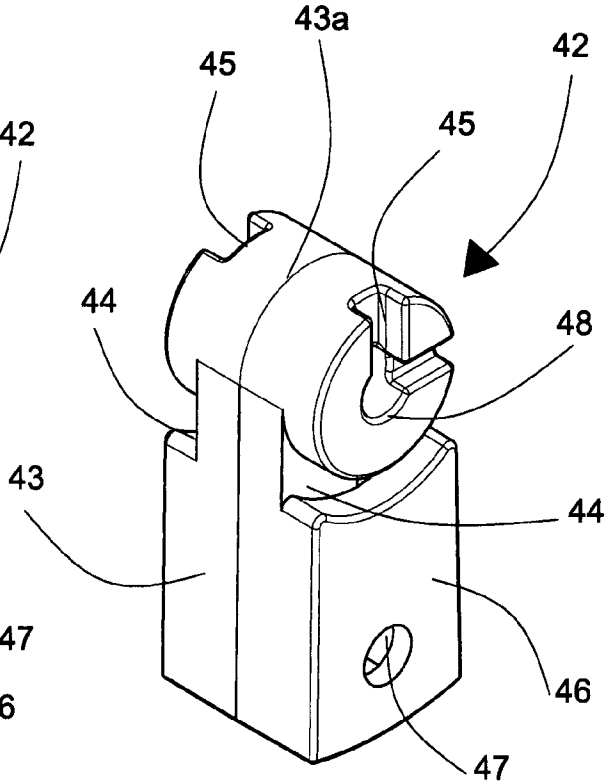
Figure 24:
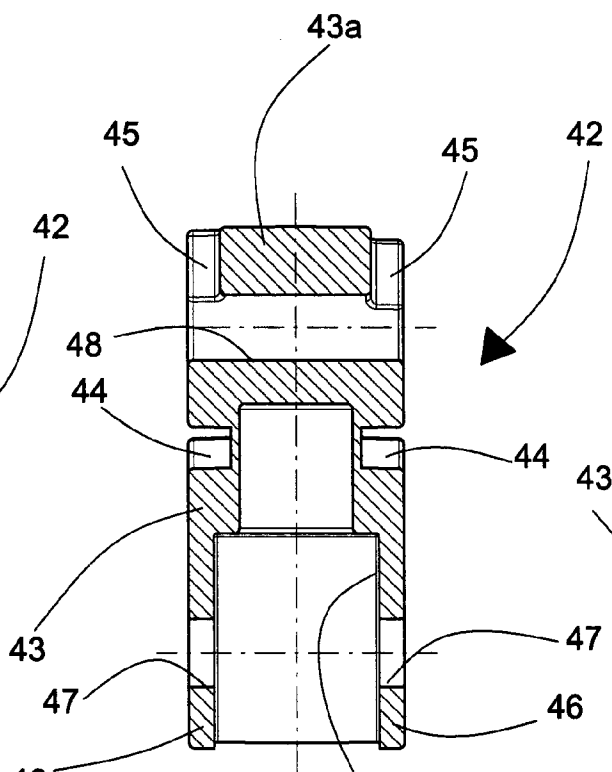
Figure 23:
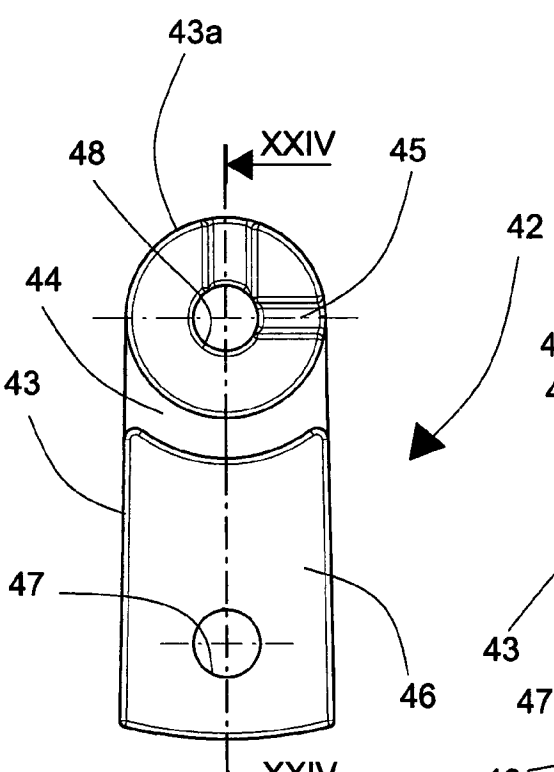
Figures 32, 33:
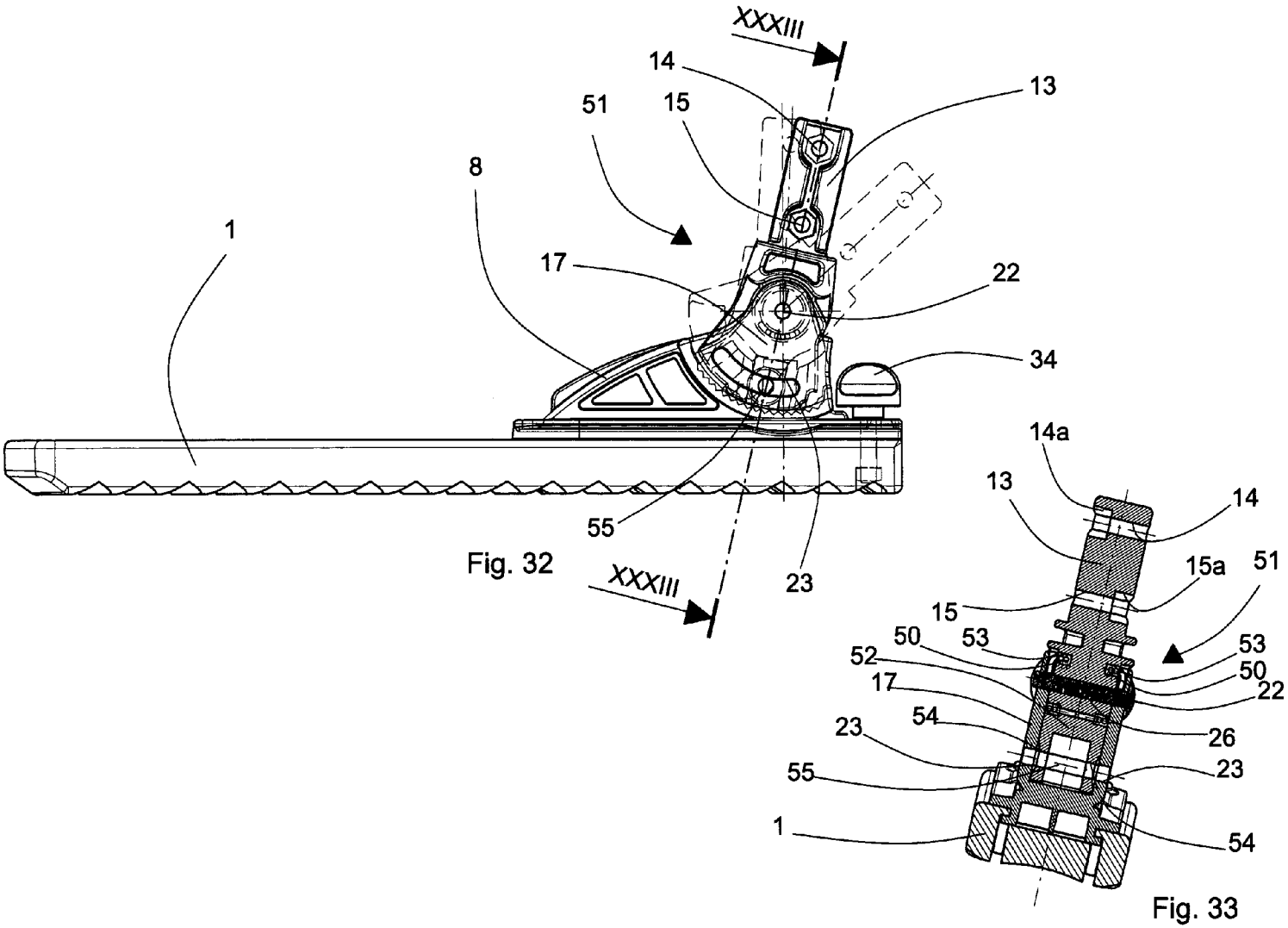
Figure 35A:
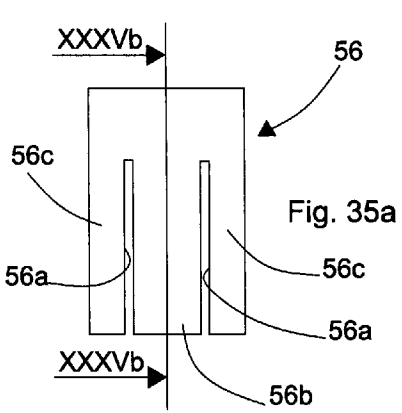
Figure 34:
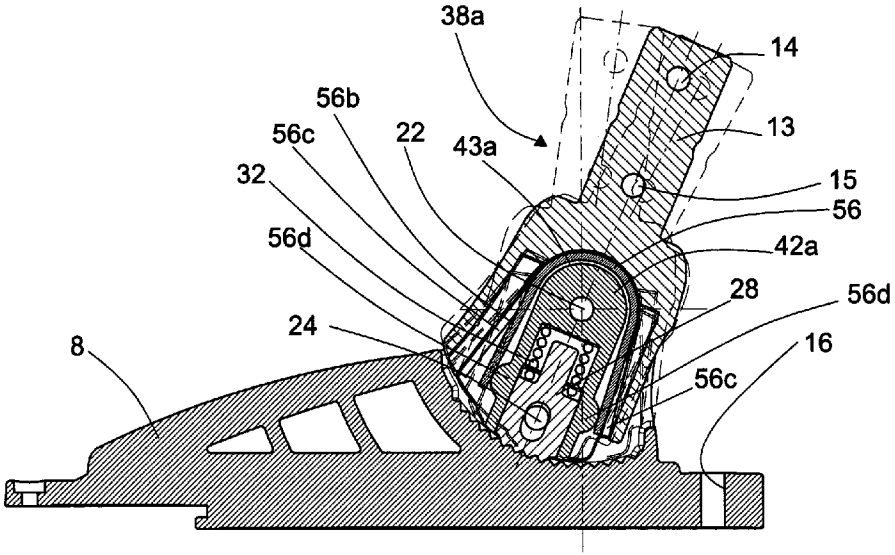
Figure 35:
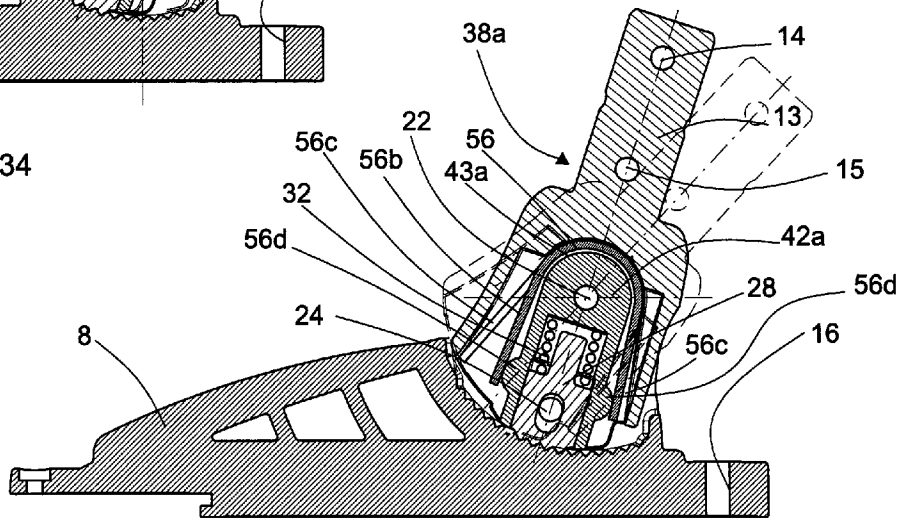
Figure 35B:
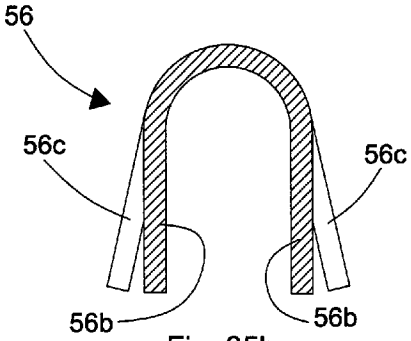

FIGS. 16*a* and 16*b* illustrate a detail of FIG. 16;

FIG. 17 is a perspective view of the set in FIG. 14;

FIG. 18 is section XVIII-XVIII of FIG. 14;

FIG. 19 is an enlarged detail of FIG. 18;

FIG. 20 is a raised view of a second embodiment of the attachment element for the handle of the tool according to the invention;

FIG. 21 is section XXI-XXI in FIG. 20;

FIG. 22 is a perspective view of the attachment element in FIG. 20;

FIG. 23 is a raised view of a damping element associable with the attachment element shown in FIGS. 20 to 22;

FIG. 24 is section XXIV-XXIV of FIG. 23;

FIG. 25 is a perspective view of the damping element in FIG. 23;

FIGS. 26 to 31 show different operating positions that the attachment element in FIG. 20 can assume in relation to the coupling element;

FIG. 32 shows a third embodiment of the attachment element associable with the coupling element in FIG. 8;

FIG. 33 is a section XXXIII-XXXIII in FIG. 32;

FIGS. 34 and 35 show a version of the second embodiment of the attachment element, shown in FIGS. 20 to 31;

FIG. 35*a* shows a detail of the version of FIGS. 34 and 35;

FIG. 35*b* is a section XXXVb-XXXVb in FIG. 35*a;*

Figure 2:
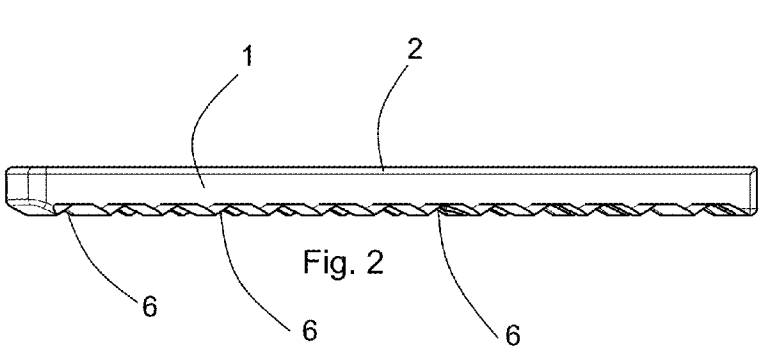
FIG. 2 is a side view of the supporting element in FIG. 1.
Figure 1:
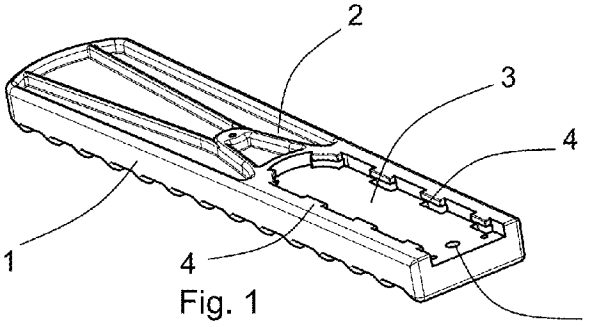
FIG. 1 is a perspective view of a supporting element of the bristles of a tool for cleaning surfaces according to the invention.
Figure 3:
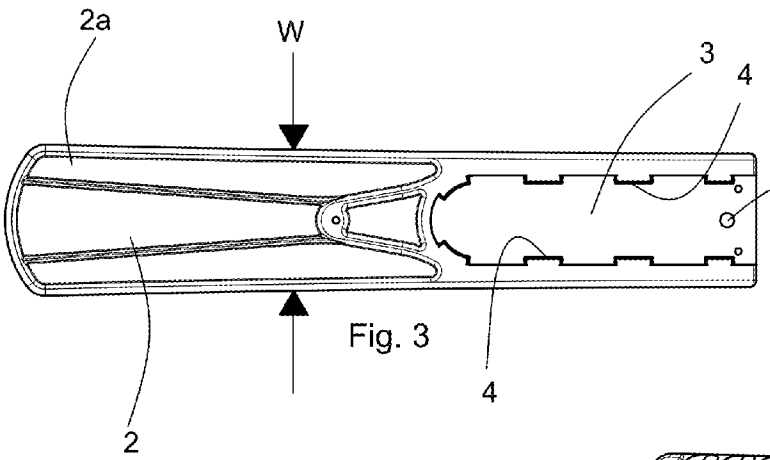
FIG. 3 is a top view of the supporting element in FIG. 1.
Figure 4:
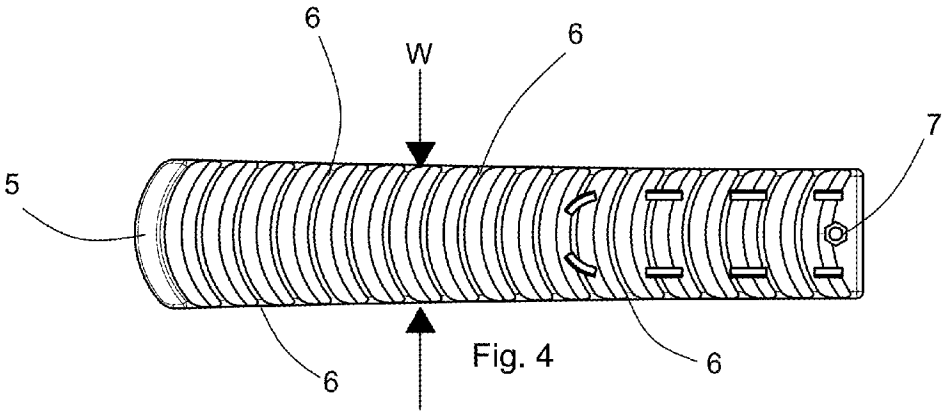
FIG. 4 is a bottom view of the support in FIG. 1.
Figure 6:
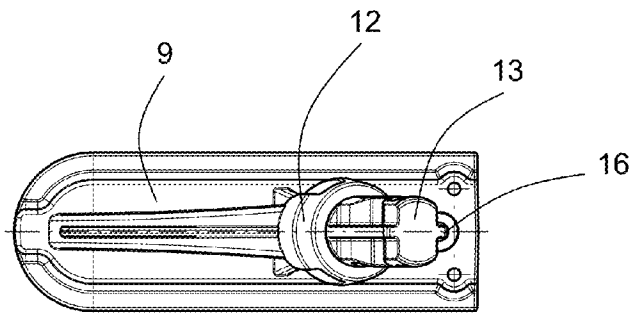
FIG. 6 is a top view of the coupling element in FIG. 5.
Figure 5:
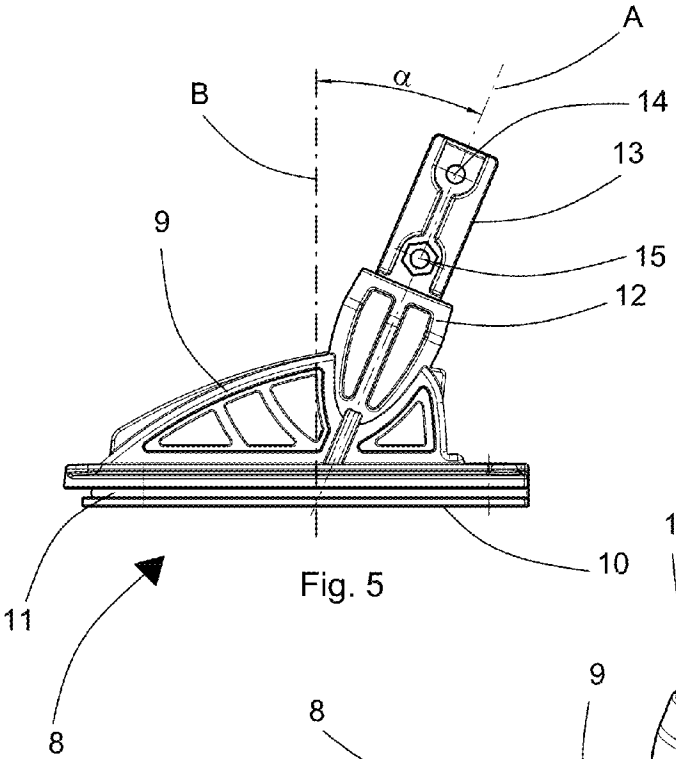
FIG. 5 is a raised view of a first embodiment of a coupling element for coupling a handle with the supporting element of the bristles.
Figure 7:
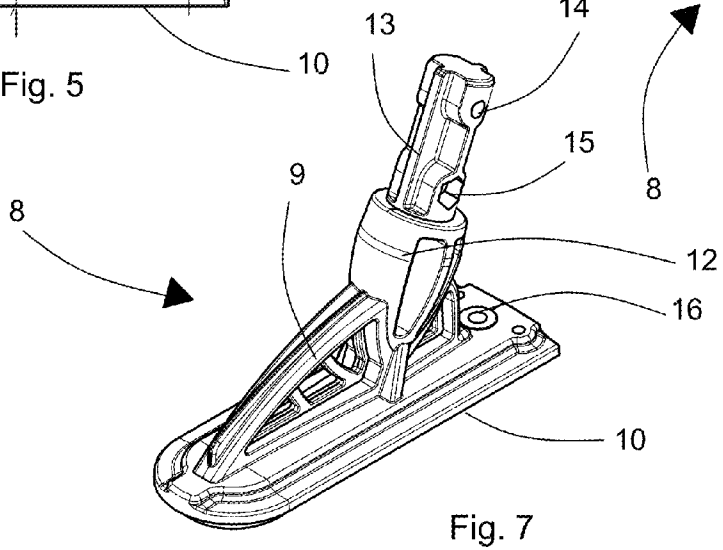
FIG. 7 is a perspective view of the coupling element in FIG. 5.
Figure 36:
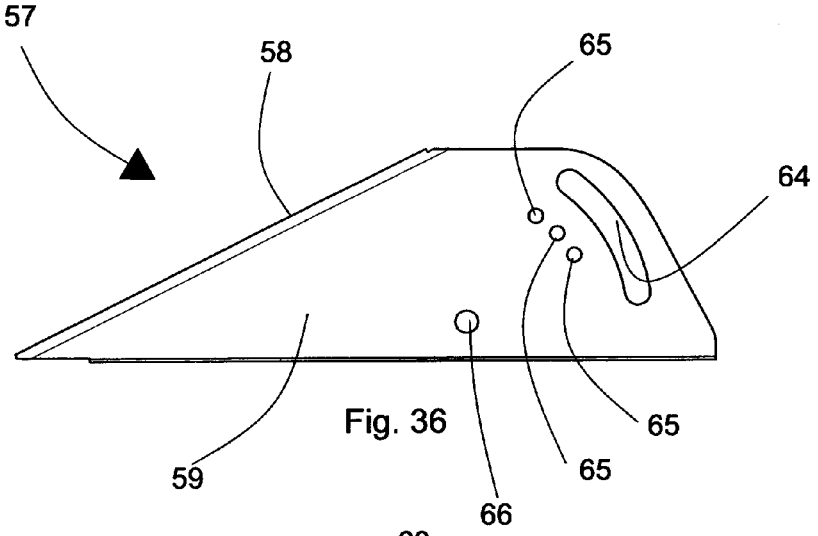
Figure 37:
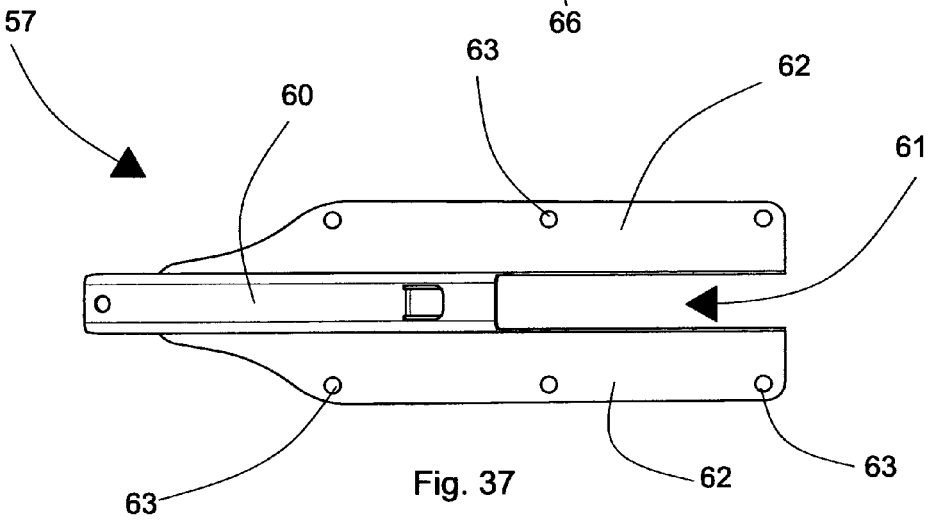
Figure 38:
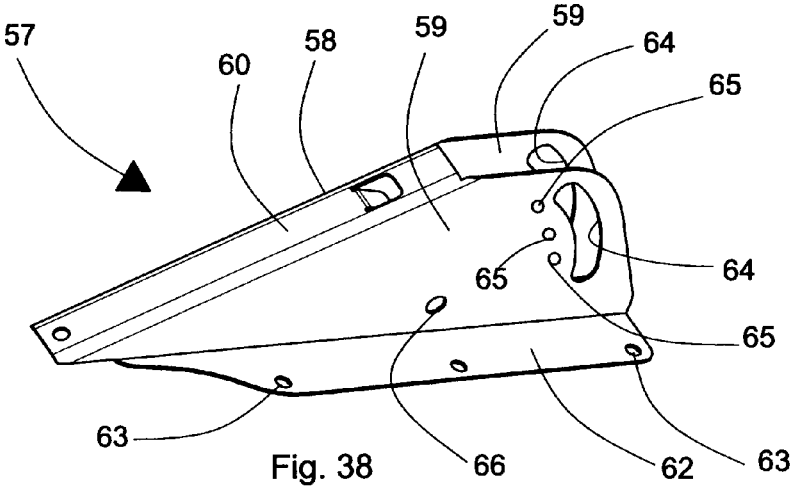
Figure 39:
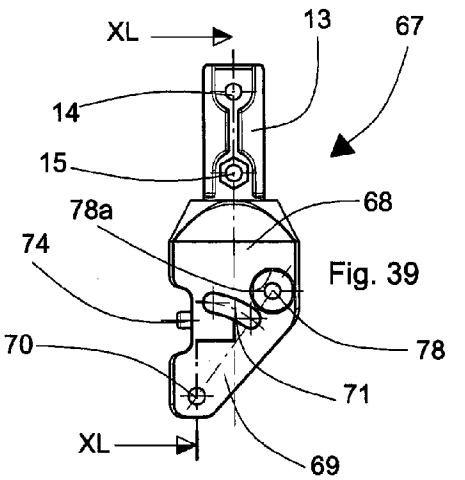
Figure 41:
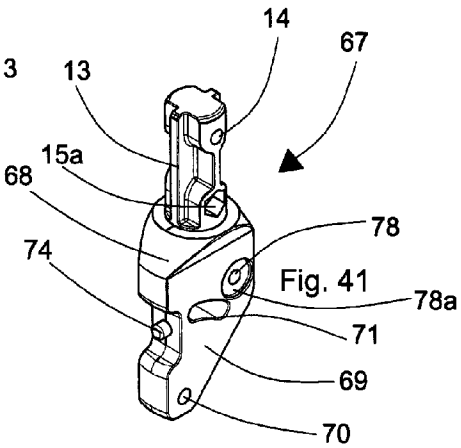
Figure 40:
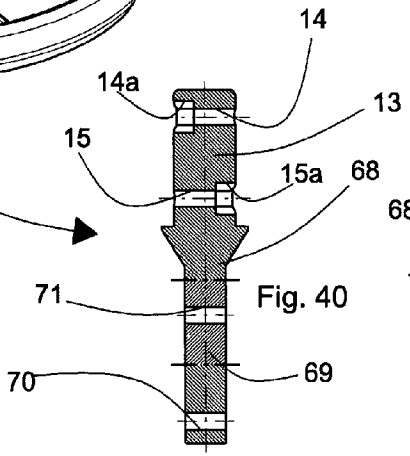
Figure 42:
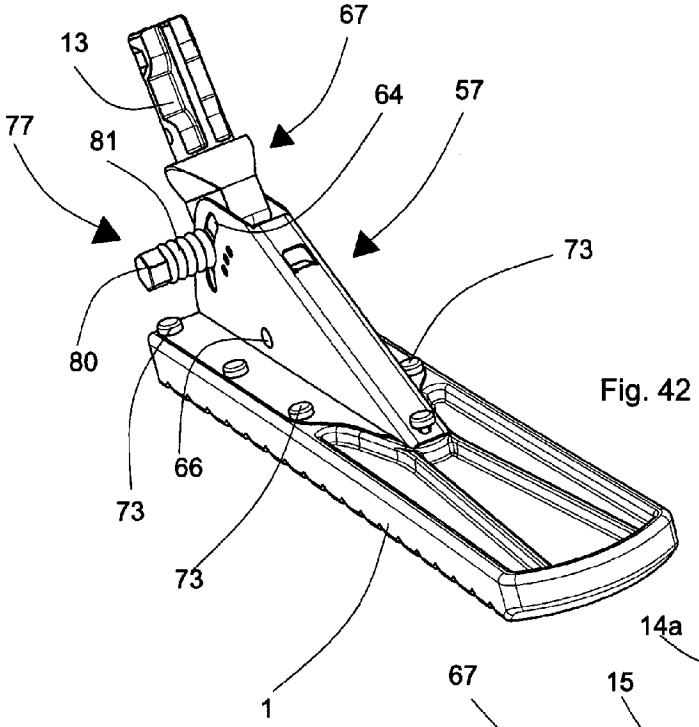
Figure 43:
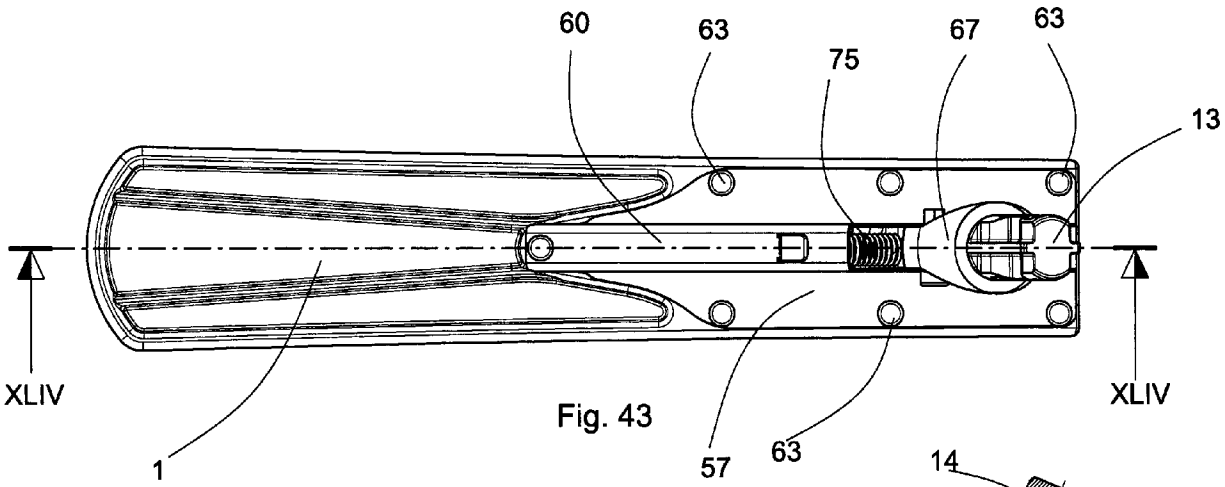
Figure 44:
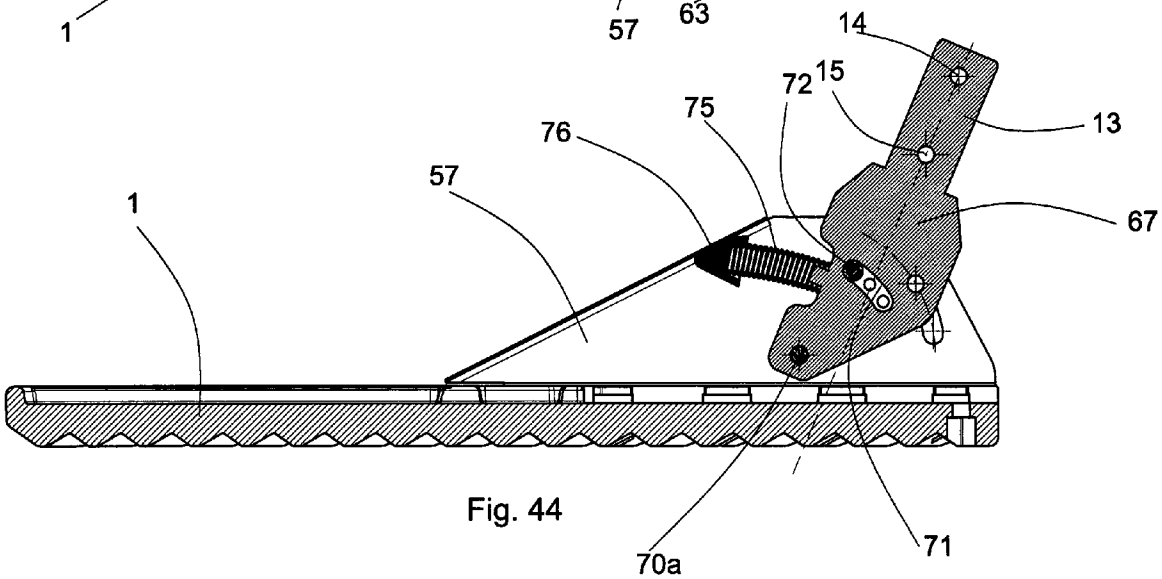
Figures 45, 46, 47, 48:
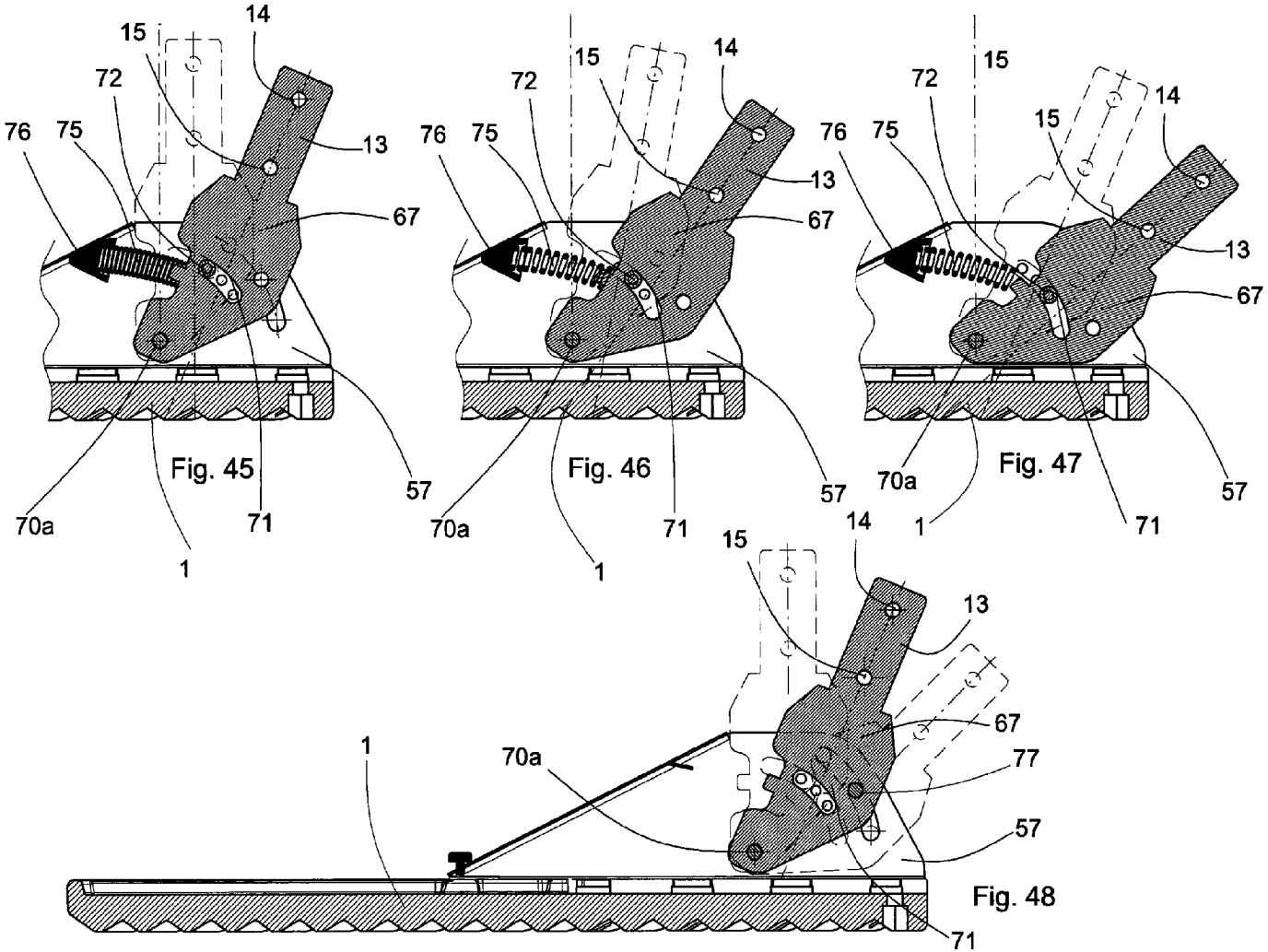
Figure 51:
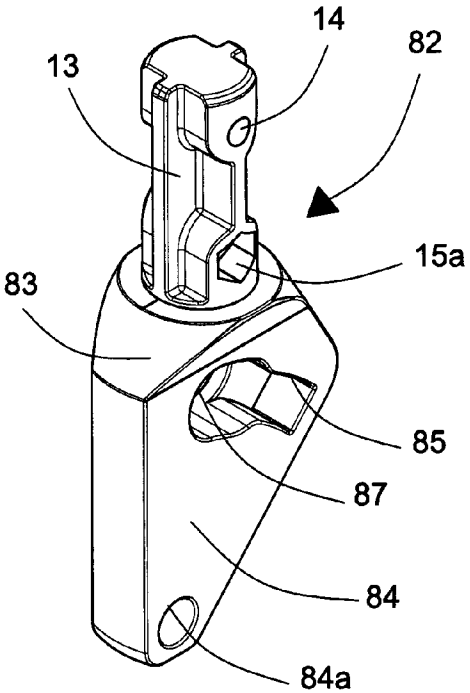
Figure 50:
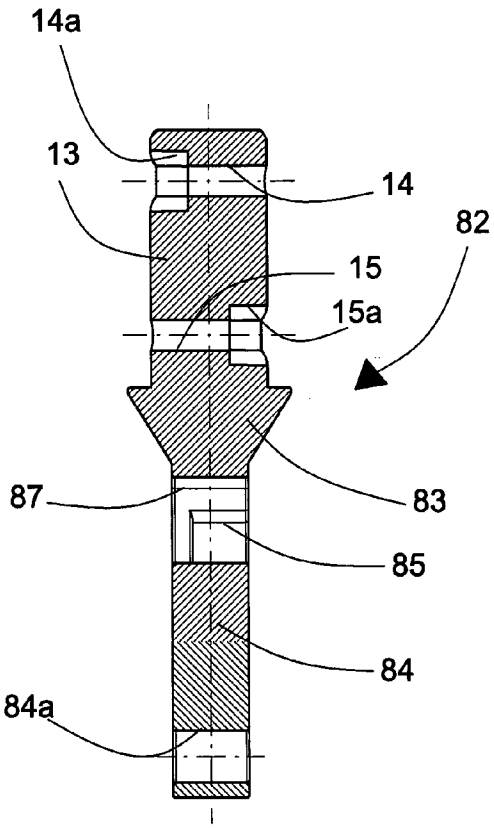
Figure 49:
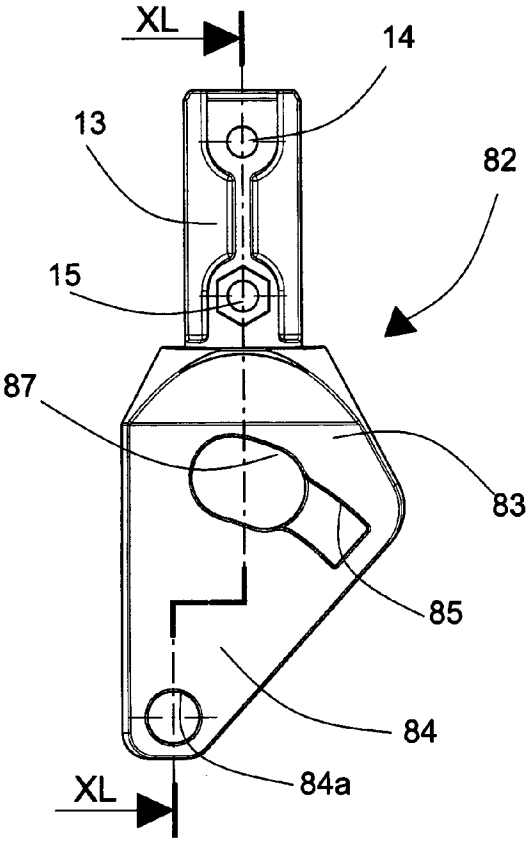
Figure 52:
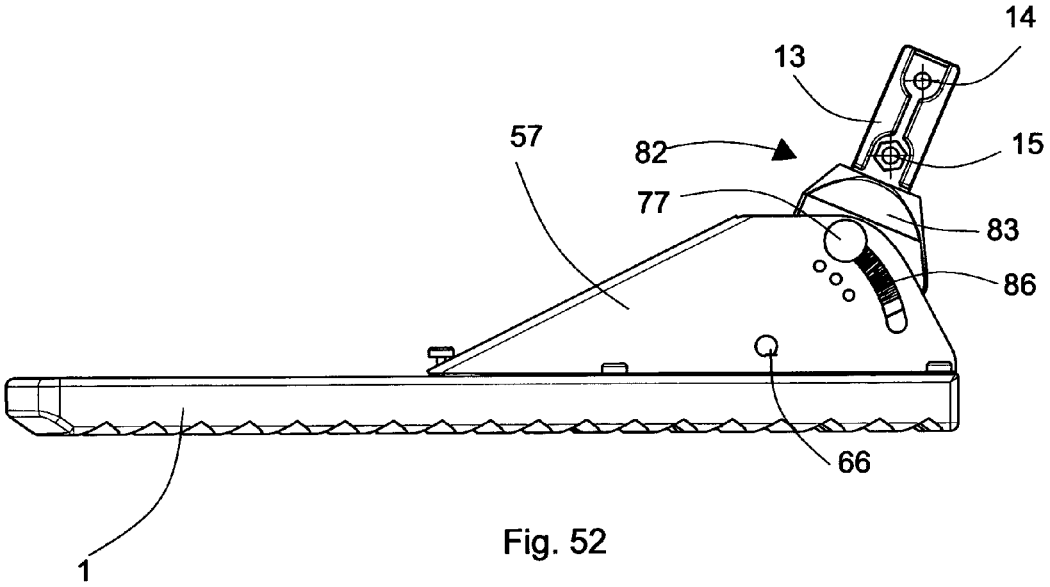
Figure 53:
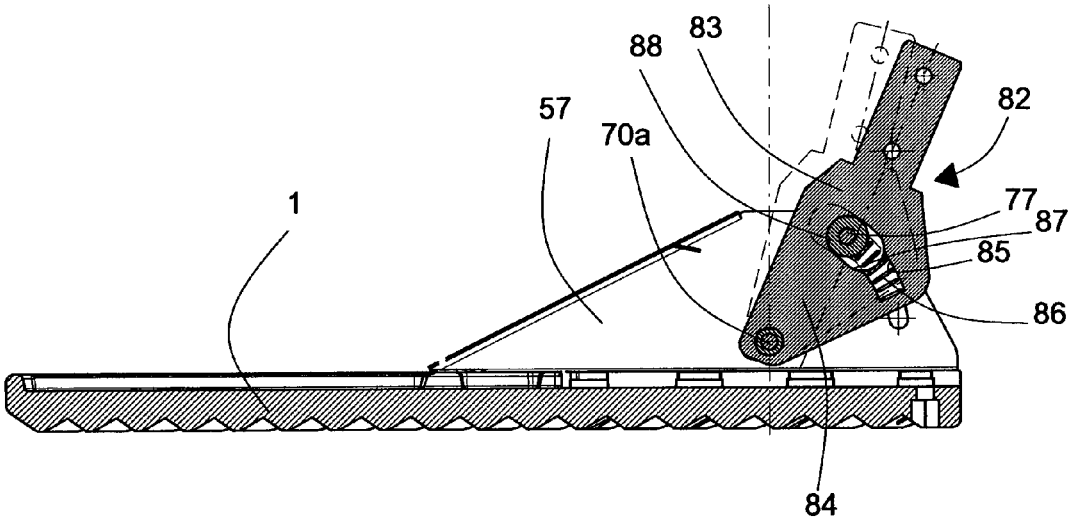
Figure 54:
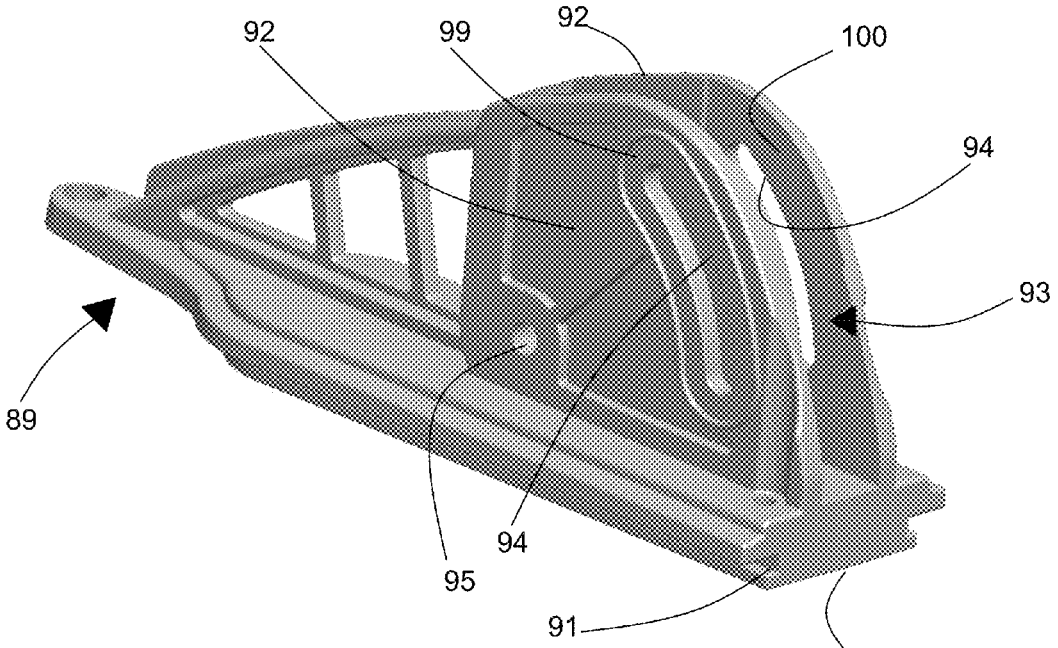
Figure 55:
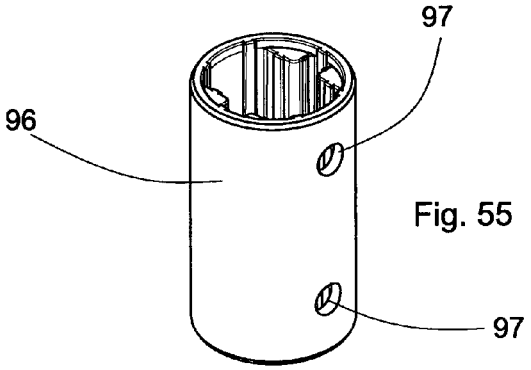
Figure 56:
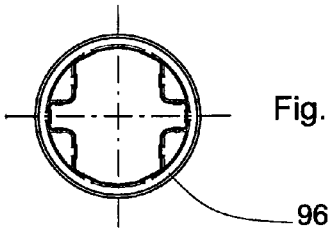

FIG. 36 is a raised view of a third embodiment of the coupling element associable with the supporting element of the bristles;

FIG. 37 is a top view of FIG. 36;

FIG. 38 is a perspective view of FIG. 36;

FIG. 39 is an elevated view of a fourth embodiment of the attachment element, associable with the coupling element shown in FIGS. 36 to 38;

FIG. 40 is section XL-XL in FIG. 39;

FIG. 41 is a perspective view of the attachment element in FIG. 39;

FIG. 42 is a perspective view of a set consisting of the coupling element in FIGS. 36 to 38, associated with the supporting element of the bristles in FIG. 1, and of the attachment element in FIGS. 39 to 41;

FIG. 43 is a top view of a mounting version of the attachment element in FIGS. 39 to 41 in the coupling element in FIGS. 36 to 38;

FIG. 44 is section XLIV-XLIV of FIG. 43;

FIGS. 45 to 47 show various operating positions that the attachment element in FIGS. 39 to 41 can assume in the mounting version shown in FIGS. 43 and 44;

FIG. 48 is a section like that in FIG. 44, relating to the set in FIG. 42;

FIG. 49 is a raised view of a fifth embodiment of the attachment element, associable with the coupling element shown in FIGS. 36 to 38;

FIG. 50 is a section XL-XL of FIG. 49;

FIG. 51 is a perspective view of the attachment element of FIG. 49;

FIG. 52 is a raised view of a set consisting of the coupling element in FIGS. 36 to 38, inserted into the supporting element of the bristles in FIG. 1, and of the attachment element in FIGS. 49 to 51;

FIG. 53 is a longitudinal section of the set of FIG. 52;

FIG. 54 is a perspective view of a fourth embodiment of the coupling element, associable with the attachment element shown in FIGS. 39 to 41 or with the attachment element shown in FIGS. 49 and 51;

FIG. 55 is a perspective view of an adapting element for connecting the handle to the attachment element;

FIG. 56 is a top view of the adapting element in FIG. 55.

Figure 57:
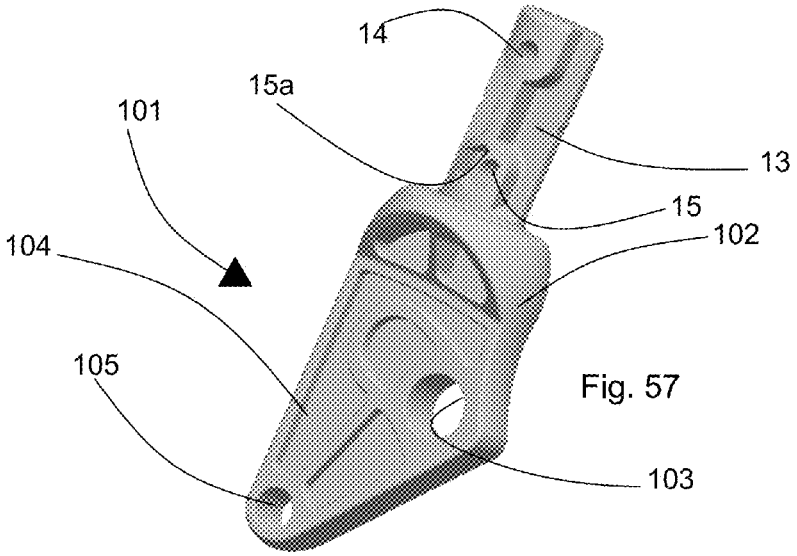
Figure 58:
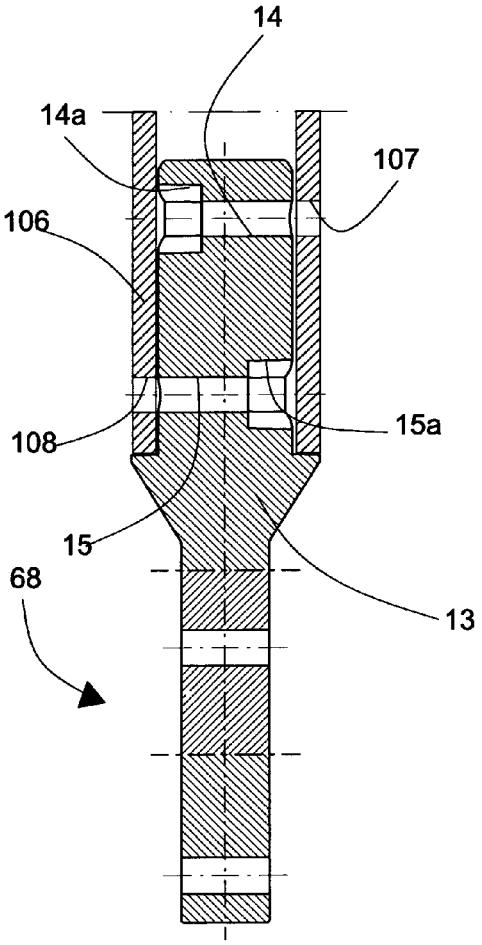
Figure 59:
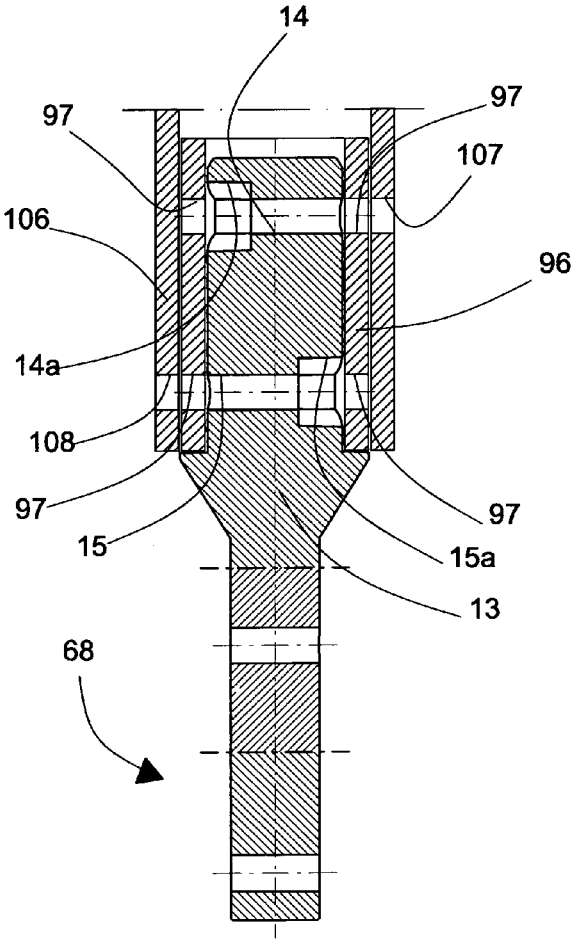

FIG. 57 shows a sixth, variant embodiment of the attachment element according to the invention;

FIGS. 58 and 59 show the mounting of the handle of the tool according to the invention on an attachment element, respectively without and with the adapting element of FIGS. 55 and 56.

In the description that follows, the elements common to the embodiments of the invention shown will be marked by the same reference numbers.

In FIGS. 1 to 4 there is shown a supporting element for bristles 1 of a tool for cleaning surfaces according to the invention, which is configured to be coupled simply and rapidly with a coupling element, which will be disclosed below, intended for receiving a handle for gripping and moving the tool.

The support for bristles 1 is provided, in a first surface 2 intended for receiving the coupling element, with a seat or cavity 3 intended to be coupled with the coupling element. The interior side walls of the support which define the cavity 3 in the first surface are provided with a series of spaced protrusions 4 projecting into the cavity 3. The protrusions prevent movements of the coupling element in a direction that is perpendicular to the supporting element 1.

A second face 5 of the supporting element 1 opposite the first face 2 is provided with a plurality of grooves 6 intended for receiving groups of bristles for removing dust and other solid substances from surfaces, the bristles being made, for example, of synthetic plastic or other materials, also of natural origin. The grooves 6 may have a circumferential arc configuration.

Figure 15:
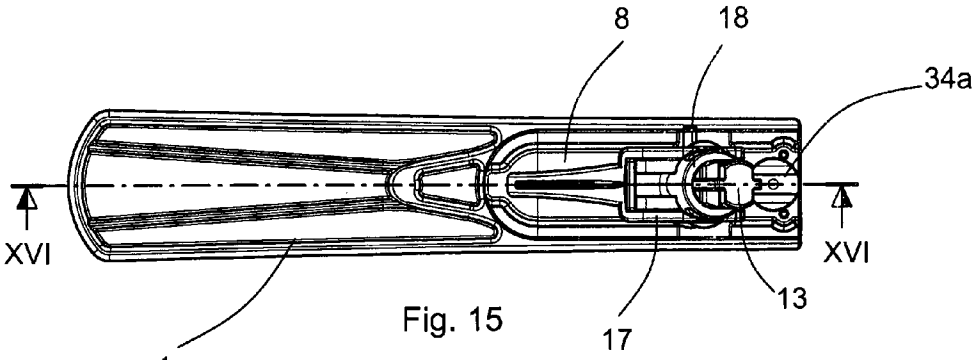
FIG. 15 is a top view of FIG. 14.

On the bottom of the seat 3 there is provided at least one hole 7 intended for receiving a fixing element 34*a* (FIG. 15), for example a screw, or another suitable fixing arrangement, for fixing the coupling element to the supporting element 1.

The width of the supporting element 1 increases progressively to a front end 2*a* thereof. This makes the tool cleaning action more effective.

In FIGS. 5 to 8 there is shown a first embodiment of a coupling element 8 suitable for coupling with the supporting element 1; the coupling element 8 is intended for coupling with a gripping element, for example a handle, by means of which it is possible to grip and handle the tool according to the invention, to remove dust or other dirt from a surface.

The coupling element 8 comprises a body 9 provided with a base 10 suitable for being slidingly inserted into the seat or cavity 3 of the supporting element 1. The base 10 includes peripheral side walls which contain a groove 11 intended for receiving the protrusions 4 of the supporting element 1, when the coupling element 8 is slidingly inserted within the cavity 3 so that movements of the coupling element 8 the cavity are prevented in a direction that is perpendicular to the surface of the supporting element 1.

The coupling element 8 comprises an attachment element 12 on which said handle can be inserted and fixed. The attachment element 12 has an axis A which is preferably tilted by an angle $\alpha$ in relation to a perpendicular B to the base 10, the angle $\alpha$ being preferably comprised between approximately 15° and approximately 30°.

The attachment element 12 is provided with a shank 13 intended to be inserted into a hollow end of said handle. The shank 13 is provided with two through holes 14 and 15 intended for receiving the stem of a respective bolt for coupling and fixing said handle to the shank 13. A respective end 14*a*, 15*a* of said through holes is shaped so as to receive the nut of the bolt; the shaped ends 14*a*, 15*a* are made on opposite sides of the shank 13 so that the handle of the tool can be mounted only on a preset angular position on the shank 13, which is particularly advantageous in the case of a handle with an ergonomic shape, to prevent the handle being mounted in an incorrect position.

In the base 10 of the body 9 there is made a hole 16, that, when the coupling element 8 is inserted into the seat 3 of the supporting element 1, is aligned with the hole 7 of said seat and is intended for receiving the fixing element 34*a*, to fix the coupling element 8 to the supporting element 1.

In FIGS. 8 to 10 there is shown a second embodiment of a coupling element 8 in which the body 9 is provided with a cradle element 17 intended for coupling with an angularly movable attachment element, for example the attachment element 18 in FIG. 11, which will be disclosed in detail below.

On the bottom of the cradle 17 there are provided protrusions 19, for example in the form of teeth that intended for fixing the angular position of the angularly movable attachment element.

The cradle 17 is provided with side walls 20 in each of which there is provided a respective through hole 21 intended for receiving a pivot 22 (FIG. 18) that constitutes the rotation axis of the attachment element in relation to the cradle 17. The bottom of the cradle 17 with the protrusions 19 can be made of an interchangeable insert, for example made of a material with great resistance to wear. In each of said side walls 20 a respective slot 23 is further made through which a locking element 24 can be inserted (FIG. 14) that is coupled with the attachment element 18 to lock the angular position thereof in relation to the cradle 17.

Figure 13:
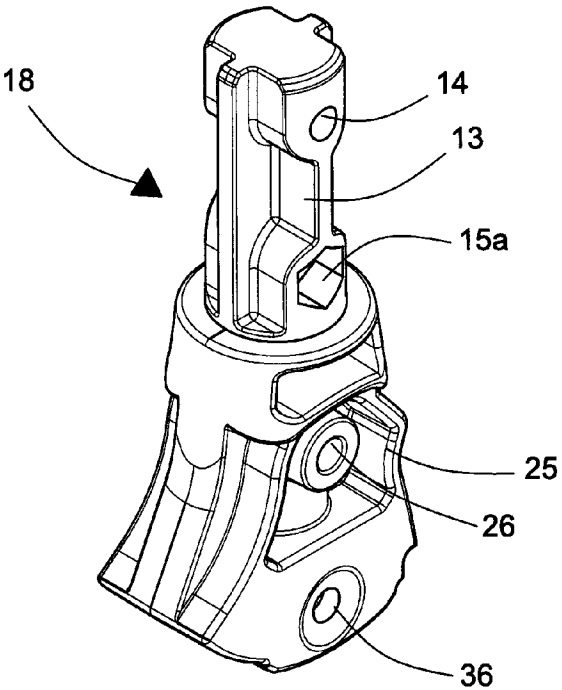
FIG. 13 is a perspective view of the attachment element in FIG. 11.
Figure 12:
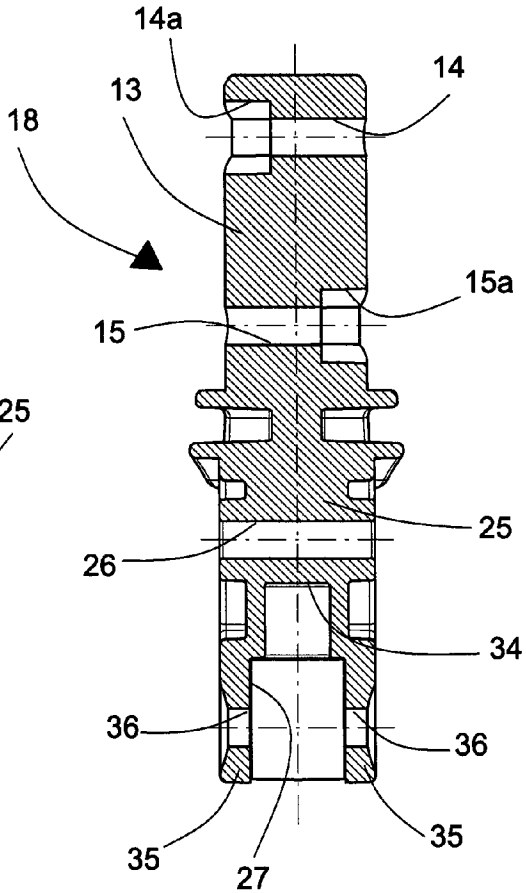
FIG. 12 is section XII-XII in FIG. 11.
Figure 11:
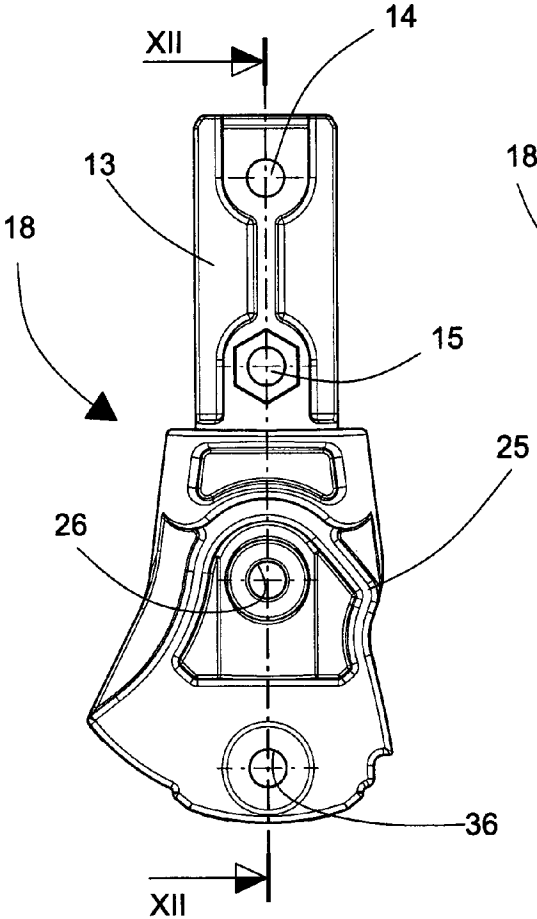
FIG. 11 is a raised view of a first embodiment of an attachment element for the handle that can be associated with the coupling element in FIGS. 8 to 10.

In FIGS. 11 to 13 there is shown the attachment element 18 that comprises a body 25 provided above with a shank 13 intended for coupling with said handle. In the shank 13 two through holes 14 and 15 are made that are intended for receiving the stem of a respective bolt for fixing said handle to the shank 13. A respective end 14*a*, 15*a* of said through holes is shaped so as to receive the nut of the bolt; the shaped ends 14*a*, 15*a* are made on opposite sides of the shank 13, to enable mounting of the handle in a predefined angular position in relation to the shank 13, as mentioned before.

In the body 25 there is made a through hole 26 intended for receiving the pivot 22 that constitutes the rotation axis of the attachment element 18 in relation to the cradle 17 of the coupling element 8.

In the lower part of the body 25 there is made a receptacle 27 intended for receiving a positioning element 28 (FIGS. 16*a*, 16*b*) intended for coupling with the protrusions 19 obtained on the bottom of the cradle 17 of the coupling element 8 to determine the angular position of the attachment element 18 in relation to the cradle 17. The positioning element 28 comprises a body 29 having a lower face provided with protrusions 30, for example in the shape of teeth, shaped so as to couple with the protrusions 19 of the cradle 17 to determine the angular position of the attachment element 18 in the cradle 17.

The body 29 can move in the seat 27 guided by the walls of the seat. The body 29 is provided with a slot 31 that can be used for the passage of the locking element 24, if it is present. The movement of the body 29 is contrasted by an elastic element 32, for example a coil spring wound around an upper protrusion or projection 33 of the body 29 and compressed between the body 29 and a bottom wall 34 of the seat 27.

The walls of the receptacle 27 enable the positioning element 28 to move in a direction substantially perpendicular to the bottom of the cradle 17, so that the protrusions 30 disengage from the protrusions 19 of the cradle 17 to enable the angular position of the attachment element 18 to be modified.

In the side walls 35 of the receptacle 27 respective through holes 36 are obtained through which the locking element 24 can pass.

The locking element 24 is optional inasmuch as the positioning element 28 is already effective for maintaining the angular position of the attachment element 18 in the cradle, owing to the action of the spring 32. In order to vary the angle, it will be sufficient to give a thrust to the handle so as to overcome the force of the spring.

The locking element 24 can consist of a screw 24*a* and of a nut 24*b*, by screwing which on the screw 24*a* it is possible to lock the attachment element 18 in the cradle 17 in a set angular position. In order to change the angular position of the attachment element 18, it is sufficient to loosen the nut 24*b*, exert on the handle connected to the attachment element 18 a thrust suitable for causing rotation of the attachment element 18 around the pivot 22, until the attachment element 18 is moved to a new angular position, finally screwing the nut 24*b* to lock the attachment element 18 in the new angular position.

When the nut 24*b* is tightened, the walls of the cradle 17 tend to become deformed in the direction of the side walls 35 of the seat 27 of the attachment element 18.

In order to obtain only partial locking of the attachment element 18, in each of said side walls 35, at said holes 36 there can be provided a slight recess 37 for assisting the deformation of the respective wall of the cradle 17 and prevent excessively high friction resistance developing between the attachment element 18 and the cradle 17, so that it is still possible to move angularly the attachment element 18 in relation to the cradle 17, exerting a thrust that is of appropriate intensity on the handle of the tool. In FIGS. 20 to 22 there is shown a second embodiment of an attachment element 38.

The attachment element 38 comprises a body 39 provided above with a shank 13 intended for coupling with said handle. In the shank 13 two through holes 14 and 15 are made that are intended for receiving the stem of a respective bolt for fixing the handle to the shank 13. A respective end 14*a*, 15*a* of said through holes is shaped so as to receive the nut of the bolt; the shaped ends 14*a*, 15*a* are made on opposite sides of the shank 13 to enable the handle to be mounted in a preset angular position in relation to the shank 13, as mentioned before.

In a pair of opposite side walls 39*a* of the body 39 respective through holes 40 are made that are aligned with one another, through which the pivot 22 passes that constitutes the rotation axis of the attachment element 38 in relation to the cradle 17 of the coupling element 8.

In the lower part of the body 39 there is obtained a damper seat 41 intended for receiving a damping element 42 (FIGS. 23 to 25) the function of which will be explained in detail below.

In a pair of opposite side walls 41*a* of said seat 41 respective further through holes 41*b* are made that are aligned together and with the through holes 40 to enable the pivot 22 to pass through.

Figure 26:
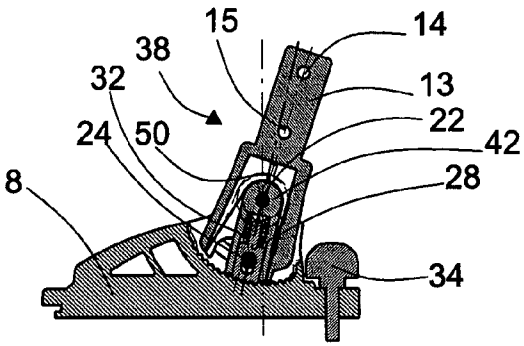
Figure 27:
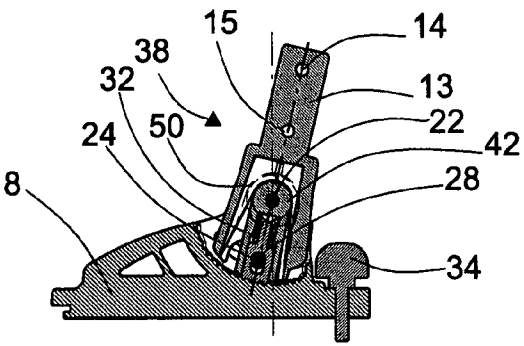
Figure 28:
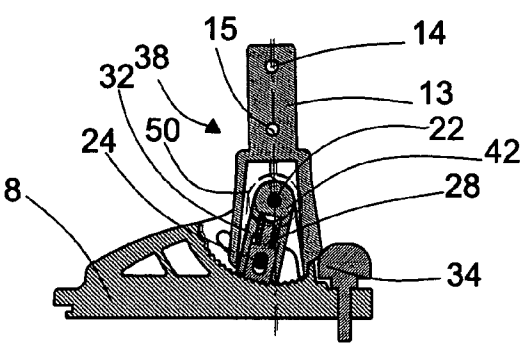
Figure 29:
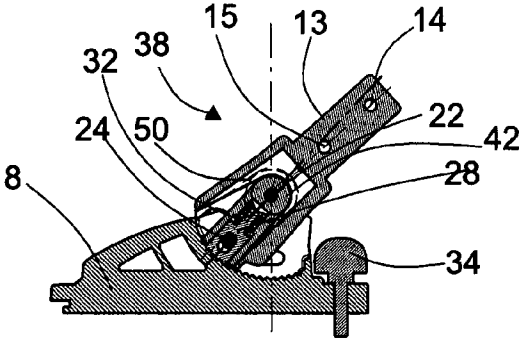
Figure 30:
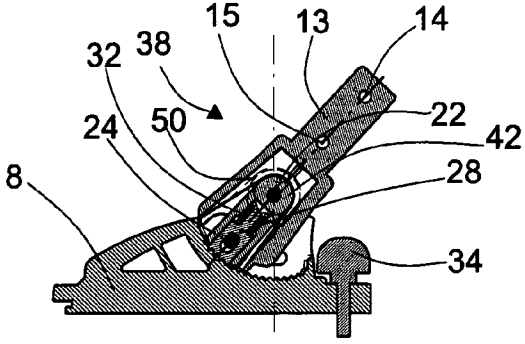
Figure 31:
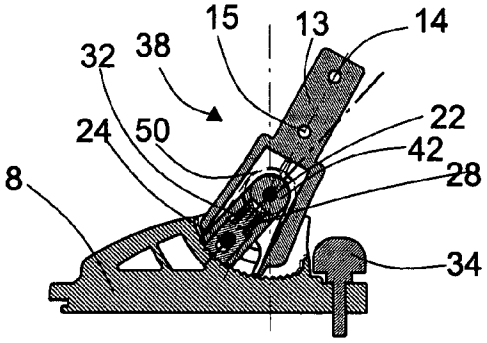

In FIGS. 23 to 25 there is shown the damping element 42, which comprises a body 43 in the top part of which, terminating above with a curved face 43*a*, there are obtained, on respective opposite faces 46, respective first seats 44 and second seats 45, intended for housing a respective torsion spring 50 (FIG. 26). In the lower part of said opposite faces 46 respective through holes 47 are obtained that are aligned with one another, through which the locking element 24 is intended to pass when the damping element 42 is inserted into the seat 41 of the attachment element 38.

In the upper part of the body 43 there is made a further through hole 48, that communicates at the ends with said second seats 45 and has an axis that is parallel to the axis of the through holes 47.

The further through hole 48 is used for the passage of the pivot 22 when the damping element 42 is inserted into the seat 41 of the attachment element 38. In the lower part of the body 43 a receiving seat 49 is made that is intended for receiving the positioning element 28 disclosed above.

When the attachment element 38 is inserted into the cradle 17, between the damping element 42 and the walls of the cradle 17 two washers 98 are interposed (shown only in the section in FIG. 21) that are used for making mechanical compression locking possible between the cradle 17 and the damping element 42. This locking, together with the downward thrust of the spring 32, means that the positioning element 28 does not disengage from the teeth 19 of the cradle 17 even if a considerable force is exerted on the handle. In this manner, by means of the locking element 24 it is possible to lock the position of the damping element 42 in relation to the cradle 17, nevertheless leaving the attachment element 38 free to oscillate around the damping element 42.

In FIGS. 26 to 31 various angular positions are shown that can be assumed by the attachment element 38 in relation to the coupling element 8; there is further illustrated the operation of the damping element 42.

When, during use of the tool according to the invention the supporting element 1 of the bristles comes in contact with an obstacle, the attachment element 38, to which the handle of the tool is connected, can rotate by a few degrees around the pivot 22, in relation to the attachment element 38, the rotation being contrasted elastically by the torsion springs 50, which are mounted in the respective seats 44, 45 and elastically absorb the stress due to the impact of the supporting element 1 against an obstacle, so that the stress is not transmitted unchanged to the handle. The torsion springs are mounted so as to act in opposite directions, so as to enable rotation of the attachment element 38 to be contrasted elastically both in a clockwise and counterclockwise direction.

In FIGS. 32 and 33 there is shown a third embodiment of an attachment element 51 according to the invention that is associable with the coupling element 8.

The attachment element 51 comprises a body 52 provided with a shank 13 intended for coupling with a handle of the tool according to the invention. In the shank 13 two through transverse holes 14 and 15 are made to receive the stem of a respective bolt for coupling and fixing said handle to the shank 13. A respective end 14*a*, 15*a* of said through holes is shaped so as to receive the nut of the bolt; the shaped ends 14*a*, 15*a* are made on opposite sides of the shank 13, to enable the handle to be mounted in a predefined angular position in relation to the shank 13, as mentioned before.

In the body 52 there is made a through hole 26 intended for receiving the pivot 22 that constitutes the rotation axis of the attachment element 51 in relation to the cradle 17 of the coupling element 8.

On opposite faces of the body 52 respective seats 53 are made, each of which is intended to house a respective torsion spring 50.

In the lower part of the body 52, on opposite sides thereof, respective through holes 54 are made that are aligned with one another and with the slits 23 of the coupling element 8 and are intended for receiving a further pivot 55 that protrudes from both ends from the through holes 54, to engage in the slits 23, so as to act as a stroke-stop element for the rotation of the attachment element 51 in relation to the coupling element 8.

The attachment element 52 is not lockable in a fixed angular position in relation to the coupling element 8, but can rotate freely in relation thereto around the pivot 22, the rotation being elastically contrasted by the torsion springs 50 and limited by the interaction between the slits 23 and the further pivot 55: in fact, when through the effect of the rotation of the attachment element 51 the further pivot knocks against the end edges of the slits 23, the rotation of the attachment element 51 stops.

The size of the rotation of the attachment element 51 obviously depends on the length of the slits.

This embodiment of the attachment element 52 is used in conditions that require frequent handle tilt variations to reach all the zones of the surface to be cleaned.

In FIGS. 34 to 35 there is illustrated a version 38*a* of the attachment element 38 shown in FIGS. 20 to 31.

In this version, the torsion springs 50 are replaced by a leaf spring 56, associated with a damping element 42*a*.

The leaf spring 56 is inserted between the upper curved surface 43*a* of the damping element 42*a* and the bottom of the seat 41 of the attachment element 38.

The leaf spring 56 has on both sides two notches 56*a*, that divide each side of the spring into a central part 56*b* and two side parts 56*c*, that diverge in relation to the central part 56*b*. The side parts 56*c* interact with the body of the attachment element 38*a* to damp possible stress transmitted to the handle of the tool according to the invention by blows of the supporting element 1 against obstacles, performing the same function as the torsion springs 50 disclosed with reference to the previously disclosed attachment element 38. The central parts 56*b* of each side of the spring interact with respective protuberances 56*d* provided on opposite walls 46 of the damping element 42*a* to maintain the latter in position.

The leaf spring 56, in relation to the torsion springs 50, has the advantage of having greater resistance to stress and greater ease of assembly.

In FIGS. 36 to 38 there is illustrated a third embodiment of a coupling element 57 according to the invention.

In this third embodiment, the coupling element 57 comprises a body 58 consisting of two walls 59 parallel to one another, partially connected by a connecting element 60, so that a space 61 between the two walls 59 remains accessible above from the outside.

The base of each wall 59 is connected to a horizontal fixing plate 62, provided with a series of holes 63 through which the fixing elements 73 (FIG. 42) can pass to connect the coupling element 57 to the supporting plate 1 of the bristles. Said fixing elements 73 may, for example, be self-tapping screws.

On each of the walls 59 there is made a slot 64 substantially with a circumference configuration, a plurality of further holes 65, arranged on a circumference arc internally concentric with respect to the slot 64 and a still further hole 66 the centre of which coincides substantially with the centre of the circumferences along which are arranged the slot 64 and the further holes 65.

The coupling element 57 is associable with a fourth embodiment of an attachment element 67 according to the invention, which is shown in FIGS. 39 to 47.

The attachment element 67 comprises a body 68 provided above with a shank 13 intended to be inserted into a hollow end of the handle of the tool according to the invention. The shank 13 is provided with two through holes 14 and 15 intended for receiving the stem of a respective bolt for coupling and fixing said handle to the shank 13. A respective end 14*a*, 15*a* of said through holes is shaped so as to receive the nut of the bolt; the shaped ends 14*a*, 15*a* are made on opposite sides of the shank 13, to enable a mounting of the handle in a preset angular position in relation to the shank 13, as mentioned before.

The lower part 69 of the body 68 has a shape and dimensions such as to be inserted with minimum clearance into the space 61 between the walls 59 of the coupling element 57.

In said lower part 69 there is made a through hole 70, that, when the attachment element 67 is inserted into the space 61 between the walls 59 of the coupling element 57, is intended to be aligned with the holes 66 of said walls 59 to receive a pivot 70*a* (FIG. 44) constituting a rotation axis of the attachment element 67 in relation to the coupling element 57. The hole 70 can be made of dimensions such as to receive a bushing that is free to rotate in the hole 70, that protrudes slightly from the ends of said hole 70 and through which the pivot 70*a* is passed. The bushing is used to prevent possible friction between the attachment element 67 and the walls 59 of the coupling element 57, which would hinder the rotation of the attachment element 67 around the pivot 70*a*.

In the body 68 a slot 71 is further made, having a circumference arc configuration intended to be aligned with the holes 65 made in the walls 59 of the coupling element 57, when the attachment element 67 is inserted into the space 61 between the walls 59 of said coupling element 57. Said holes 65 and said slot 71 are used to define the angular excursion of the attachment element 67 in relation to the coupling element 57. In fact, by inserting a plug 72 into a pair of corresponding holes 65 of the walls 59 the latter acts as a stroke stop for the angular excursion of the attachment element 67 in relation to the coupling element 57. In fact, the plug 72 passes through the slot 71 and when, through the effect of rotation of the attachment element 67 it comes into contact with an end wall of the slot 71, it prevents further rotation of the attachment element 67 in the direction of said end wall.

The body 68 has a protrusion 74 on which is fixed an end of an elastic element 75, for example a coil spring, the opposite end of which is fixed to a fixing element 76 provided on the connecting element 60.

The elastic element 75 is used to absorb and dampen stress due to blows of the supporting element 1 against possible obstacles during use of the tool according to the invention. The angular position of the attachment element 67 in relation to the coupling element 57 can be fixed by a locking element 77, for example consisting of a bolt, the stem of which passes through the slots 64 of the walls 59 of the coupling element 57 and through a through hole 78 made in the body 68 of the attachment element 67.

Between a head 80 of the locking element 77 and the corresponding wall 59 of the coupling element 57 there is inserted a further elastic element 81, for example a coil spring, for adjusting the clamping force exerted by the locking element 77. This clamping force determines the friction resistance that develops between the walls 59 of the coupling element 57 and the body 68 of the attachment element 67 and which contrasts the rotation of the attachment element 67 in relation to the coupling element 57, so as to enable or prevent rotation movements of the attachment element 67 according to whether, during use of the tool according to the invention, a variation of the angle of the element 67 in relation to the element 57 is necessary or not.

In order to reduce wear to the body 67, concentrically to the hole 78 there is a seat 78*a* into which a washer in wearproof material can be inserted.

In FIGS. 45 to 47 different angular stroke stops of the attachment element 67 are shown that are obtainable by inserting the plug 72 into the various holes 65 made in the walls 59 of the coupling element 57.

In FIG. 48 there is illustrated a version of the coupling between the attachment element 67 and the coupling element 57, in which there is no elastic element 75. In this case, the damping of stress due to possible blows of the tool against an obstacle is entrusted to the friction resistance between the walls 59 of the coupling element 57 and the body of the attachment element 67, which is adjustable by tightening the bolt 77 and the further spring 81 inserted onto the shaft of the bolt 77.

In FIGS. 49 to 51 there is illustrated a fifth embodiment of an attachment element 82 according to the invention, associable with the coupling element 57.

The attachment element 82 comprises a body 83 provided above with a shank 13 intended to be inserted into a hollow end of the handle of the tool according to the invention. The shank 13 is provided with two through holes 14 and 15 intended for receiving the stem of a respective bolt for coupling and fixing said handle to the shank 13. A respective end 14*a*, 15*a* of said through holes is shaped so as to receive the nut of the bolt; the shaped ends 14*a*, 15*a* are made on opposite sides of the shank 13, to enable a mounting of the handle in a preset angular position in relation to the shank 13, as mentioned before.

The lower part 84 of the body 83 has a shape and dimensions such as to be inserted with minimum clearance into the space 61 between the walls 59 of the coupling element 57.

In said lower part 84 a through hole 84*a* is made that, when the attachment element 82 is inserted into the space 61 between the walls 59 of the coupling element 57, is intended to align itself on the holes 66 of said walls 59 to receive the pivot 70*a* constituting the rotation axis of the attachment element 82 in relation to the coupling element 57.

Said pivot 70*a* can be housed inside a bushing, as already disclosed above.

In the body 83 a housing seat 85 is further obtained that is intended for housing an elastic element 86 (FIGS. 52 and 53), for example a coil spring. The housing seat 85 communicates at an end with a slot 87 into which a bushing 88 is inserted into which the spindle of the locking element 77 disclosed above passes.

The slot 87 has a shape and dimensions such as to permit small rotations of the attachment element 82 in relation to the coupling element 57 when the locking element is in the clamping position.

These small rotations of the attachment element 82 are contrasted by the spring 86, which thus damps possible anomalous stress due to blows of the tool against obstacles, so that said anomalous stress is not transmitted unaltered to the handle of the tool. The attachment element 82 has the advantage that the springing force provided by the spring 85 is constant in any corresponding angular position of the attachment element in relation to the coupling element.

The slot 87 and the bushing 88 can be dimensioned so that the bushing 88 can receive the coil spring 81, to adjust the clamping force exerted by the locking element 77. In this case, the coil spring 81 is thus not visible on the outside of the coupling element, making the aesthetics thereof more appealing.

In FIGS. 52 and 53 there is shown the attachment element 82 mounted in the coupling element 57.

In FIG. 54 there is shown a fourth embodiment of a coupling element 89 according to the invention. The coupling element 89 is suitable for coupling with the attachment elements 67, or 82.

The coupling element 89 is provided with a base 90 suitable for being slidingly inserted into the seat 3 of the supporting element 1. The base 90 is provided peripherally with a groove 91, intended for coupling with the protrusions 4 of the supporting element 1, so that movements of the coupling element 89 are prevented in a direction perpendicular to the seat 3 of the supporting element 1.

The coupling element 89 further comprises two walls 92 that are parallel to one another that rise from the base 90 and are substantially perpendicular thereto; the two walls 92 define a space 93 together into which the lower part 69, respectively 84, of an attachment element 67, respectively 82, is inserted.

On each of the walls 92 there is made a slot 94, with a substantially circumference arc configuration, intended for the passage of the stem of the bolt 80, to enable or prevent a possible variation of the angular position of the attachment element.

The slot 94 is surrounded by respective seats 99 and 100 made respectively on the external side and on the internal side of the respective wall 94, said seats 99, 100 being suitable for housing respective wearproof elements (not shown) the object of which is to prevent progressive wear to the walls 94 through the effect of the friction that develops between the walls 94 and the attachment element when the locking element is clamped.

Each wall 92 is further provided with a hole 95 that is intended to align itself with the hole 70, respectively 84*a*, of the attachment element 67, respectively 82, for receiving the pivot 70*a* constituting the rotation axis of the attachment element 67, respectively 82, in relation to the coupling element 89.

In FIGS. 55 and 56 there is illustrated an adapting element 96 that is insertible in a shapingly coupled manner onto the shank 13 of an attachment element and is intended to be inserted into the hollow end of the handle of the tool. By varying the external diameter of the adapting element 96 it is possible to couple handles of various diameter with the attachment element.

The adapting element 96 is provided with holes 97 for passing fixing elements of the handle to the shank 13.

The shaping coupling between the adapting element 96 and the shank 13 is made in such a manner that when the handle of the attachment element is extracted the adaptor remains fixed to the shank 13.

In FIG. 57 there is illustrated a sixth embodiment of an attachment element 101, associable with the coupling element 57, or 89. The attachment element 101 comprises a body 102 provided above with a shank 13 intended to be inserted into a hollow end of the handle of the tool according to the invention. The shank 13 is provided with two through holes 14 and 15 intended for receiving the stem of a respective bolt for coupling and fixing said handle to the shank 13. A respective end 14*a*, 15*a* of said through holes is shaped so as to receive the nut of the bolt; the shaped ends 14*a*, 15*a* are made on opposite sides of the shank 13, to enable a mounting of the handle in a preset angular position in relation to the shank 13, as mentioned before.

The lower part 104 of the body 102 has a shape and dimensions such as to be inserted with minimum clearance into the space 61 between the walls 59 of the coupling element 57, and the space 93 between the walls 92 of the coupling element 89.

In said lower part 104 there is made a through hole 105, that, when the attachment element 101 is inserted into the space 61 between the walls 59 of the coupling element 57, or into the space 93 between the walls 92 of the coupling element 89, is intended to be aligned with the holes 66 of said walls 59, or with the holes 95 of said walls 92, to receive the pivot 70*a* constituting the rotation axis of the attachment element 101 in relation to the coupling element 57, or 89.

Said pivot 70*a* can be housed inside a bushing, as already disclosed above.

In the body 102 there is further obtained a further through hole 103 into which a bushing is insertable in which the stem of the locking element 77 disclosed above passes.

The further through hole 103 and said bushing can be dimensioned so that the bushing can receive the coil spring 81 to adjust the clamping force exerted by the locking element 77. In this case, the coil spring 81 will thus not be visible from the outside of the coupling element, making the aesthetics thereof more appealing.

In FIGS. 58 and 59 there is shown the coupling between the handle 106 of the tool according to the invention and the shank 13 of an attachment element, with or without the interposition of an adapting element 96. In the Figures there is shown the coupling with an attachment element 68, but it is to be understood that the coupling between the handle and the attachment element occurs in the same manner as for all the attachment elements disclosed above.

The handle 105, at the end thereof intended to be coupled with the shank 13 of the attachment element, is provided with a first hole 107, intended to be aligned with the end of the hole 14 of the shank 13 opposite the seat 14*a*, and with a second hole 108, intended to be aligned with the end of the hole 15 of the shank 13 opposite the seat 15*a*. The arrangement of the holes 107 and 108 is such that the handle 105 can be mounted on the shank 13 in a preset angular position, that position, i.e. in which the holes 107 and 108 are aligned with the holes 14 and 15 of the shank 13, as disclosed above. This is particularly advantageous when the handle 105 has an ergonomic shape that requires a preset mounting position, inasmuch as the arrangement of the holes 107 and 108 prevents the handle being mounted in a position that is not correct, i.e. in a position other than the preset position.

In the case of mounting with the adapting element 96, the holes 97 of the adapting element will be aligned with the holes 107 and 108 of the handle 105 and with the holes 14 and 15 of the shank 13.

In the practical embodiment, the materials, dimensions and constructional details may be different from those indicated but be technically equivalent thereto without thereby going beyond the scope of the invention, as defined by the claims.

The invention claimed is:

1. A tool for cleaning surfaces, comprising A tool for cleaning surfaces, comprising:

a supporting element including a first surface containing a longitudinally extending cavity, said supporting element further including interior side walls which define said cavity and which include a series of lateral spaced supporting element protrusions projecting into said cavity;

a coupling element removably connected with said supporting element within said cavity, said coupling element including a base which slides longitudinally within said cavity, said base including peripheral side walls which contain a groove for receiving said supporting element protrusions when said coupling element is slidingly inserted within said cavity, said supporting element protrusions preventing movement of said coupling element from said cavity in a direction perpendicular to said first surface, said coupling element including a cradle element having spaced parallel side walls and including a plurality of cradle element protrusions extending from a bottom thereof and an attachment element pivotally connected with said cradle element between said cradle element side walls for angular movement relative to said coupling and supporting elements, said attachment element including a shank and a recess into which an elastic damping element is housed for opposing pivotal movement of said attachment element, said elastic damping element including a receptacle for receiving a positioning element comprising a body having a lower surface provided with protrusions configured to couple with said cradle element protrusions; and a handle having a hollow end for receiving said attachment element shank, said handle being operable for maneuvering the tool.

2. A tool as defined in claim 1, wherein said attachment element has an axis arranged at an angle with respect to said base.

3. A tool as defined in claim 2, wherein said angle is between 15° and 30°.

4. A tool as defined in claim 1, wherein said cradle element protrusions are shaped as teeth.

5. A tool as defined in claim 1, wherein each of said cradle element side walls contains a slot, and further comprising a locking element arranged in said side wall slots, respectively, for locking an angular position of said attachment element in relation to said cradle element.

6. A tool as defined in claim 1, wherein said attachment element shank contains two through holes, and further comprising a fixing element arranged in said through holes for fixing said handle to the attachment element shank.

7. A tool as defined in claim 6, wherein one end of each of said through holes is configured to receive a nut of said fixing element, said ends being arranged on opposite sides of the shank.

8. A tool as defined in claim 1, wherein each of the side walls of said cradle element is provided with a respective through hole suitable for receiving a pivot.

9. A tool as defined in claim 1, wherein each of said cradle element side walls contains a slot, and further comprising a locking element arranged in said slots, respectively, for locking said attachment element in an angular position with respect to said cradle element and wherein said positioning element body contains a slot for receiving said locking element.

10. A tool as defined in claim 9, wherein said cradle element side walls contain through holes aligned with one another for receiving said locking element.

11. A tool as defined in claim 1, wherein said positioning element body further contains a projection onto which a coil spring is inserted.

12. A tool as defined in claim 1, wherein said elastic damping element comprises a leaf spring attached to with a curved upper face of said elastic damping element.

13. A tool as defined in claim 1, wherein opposite faces of said damping element contain through holes aligned with one another for receiving a locking element for locking an angular position of said attachment element with respect to said cradle element.

14. A tool as defined in claim 13, wherein said damping element is provided with a further through hole having an axis parallel to an axis of said through holes.

15. A tool as defined in claim 1, wherein each of said cradle element side walls contains a slot with a substantially circumferential arc configuration.

16. A tool as defined in claim 15, wherein said attachment element comprises a body having a lower part configured for insertion into a space between said cradle element side walls.

17. A tool as defined in claim 16, wherein said lower part contains a through hole for receiving said pivot.

18. A tool as defined in claim 16, wherein said attachment element body comprises a damper seat, an end of said damper seat communicating with a slot for receiving a bushing which receives a locking element for locking an angular position of said attachment element body with respect to said cradle element.

19. A tool as defined in claim 16, wherein said body of said attachment element contains a through hole suitable for receiving a bushing which receives a locking element.

20. A tool as defined in claim 18, wherein said locking element comprises a bolt passing through said slots of said walls of the cradle element and through said bushing.

21. A tool as defined in claim 1, wherein each of said cradle element side walls contains a hole aligned with one another for receiving a pivot defining a rotating axis of said attachment element with respect to said coupling element.

22. A tool as defined in claim 1, wherein a width of said supporting element increases progressively towards a front end of the supporting element.

* * * * *